US009997013B2

(12) United States Patent
Litman

(10) Patent No.: US 9,997,013 B2
(45) Date of Patent: Jun. 12, 2018

(54) GAMING TABLE, NOVEL EVENT GENERATOR AND METHOD OF ALTERING UNDERLYING GAMES ON THE GAME TABLE

(71) Applicant: Mark A. Litman, Edina, MN (US)

(72) Inventor: Mark A. Litman, Edina, MN (US)

( * ) Notice: Subject to any disclaimer, the term of this patent is extended or adjusted under 35 U.S.C. 154(b) by 0 days. days.

(21) Appl. No.: 15/376,841

(22) Filed: Dec. 13, 2016

(65) Prior Publication Data

US 2017/0140604 A1 May 18, 2017

Related U.S. Application Data

(63) Continuation-in-part of application No. 14/789,995, filed on Jul. 2, 2015, and a continuation-in-part of application No. 14/805,863, filed on Jul. 22, 2015, and a continuation-in-part of application No. 14/829,800, filed on Aug. 19, 2015.

(51) Int. Cl.
*G07F 17/32* (2006.01)
*A63F 3/00* (2006.01)

(52) U.S. Cl.
CPC ..... *G07F 17/322* (2013.01); *G07F 17/3211* (2013.01); *G07F 17/3225* (2013.01); *G07F 17/3258* (2013.01); *G07F 17/3293* (2013.01); *A63F 2003/00164* (2013.01); *G07F 17/3288* (2013.01)

(58) Field of Classification Search
CPC ..... G07F 17/322; G07F 17/3288; A63F 2003/00164; A63F 1/12
See application file for complete search history.

(56) References Cited

U.S. PATENT DOCUMENTS 6,152,822 A * 11/2000 Herbert ..... G07F 17/32 463/16
2009/0189351 A1* 7/2009 Baerlocher ..... G07F 17/32 273/309
2014/0248932 A1* 9/2014 Rudd ..... G07F 17/3293 463/12

* cited by examiner

*Primary Examiner* — William H McCulloch, Jr.
*Assistant Examiner* — Yingchuan Zhang
(74) *Attorney, Agent, or Firm* — Mark A. Litman & Associates, P.A.

(57) ABSTRACT

A gaming system enables enhancement of wagering outcomes using: a) a gaming table having a game play surface for multiple players; b) a programmable electronic random number generator; c) a player input control at a player position; d) a display system capable of indicating a secondary random event outcome provided by the programmable electronic random number generator for each of the multiple players; and e) the random number generator configured to control of a display individual player position secondary random events determined by the random number generator. The gaming system is configured so that i) after at least one wager has been locked in at a player position, ii) the secondary random event for the player position is indicated and locked into the display system for a round of play of an underlying primary wagering event at the gaming table.

1 Claim, 9 Drawing Sheets

250

| 252a | 252b | 252c |
|---|---|---|
| ACE OF SPADES | 2 OF SPADES | 3 OF SPADES |
| 0 | Φ 254b | 0 |
| Φ 254a | 0 | 0 |
| 0 | 0 | Φ 254c |
| 0 | 0 | 0 |

FIG. 2

GAMING TABLE, NOVEL EVENT GENERATOR AND METHOD OF ALTERING UNDERLYING GAMES ON THE GAME TABLE

RELATED APPLICATION DATA

Applicants claim priority from PROVISIONAL APPLICATIONS: SIDE BETS FOR BLACKJACK OR BACCARAT WITH OPTIONAL PROGRESSIVE EVENT; U.S. Provisional Ser. No. 62/172,266, filed 8 Jun. 2015; and U.S. Provisional Application Ser. No. 62/183,543, SIDE BETS FOR BLACKJACK OR BACCARAT WITH PROGRESSIVE EVENT, filed 23 Jun. 2015; and SIDE BETS FOR BLACKJACK OR BACCARAT WITH PROGRESSIVE EVENT, U.S. provisional Application Ser. No. 62/209,981, filed 26 Aug. 2015; and in and claim priority under 35 USC 120 as continuation-in-part applications from U.S. patent application Ser. No. 14/789,995; 2 Jul. 2015; U.S. patent application Ser. No. 14/805,863; 22 Jul. 2015, SIDE BETS FOR BLACKJACK OR BACCARAT WITH OPTIONAL PROGRESSIVE EVENT; SIDE BETS FOR PLAYING CARD WAGERING EVENTS WITH OPTIONAL PROGRESSIVE EVENT; and U.S. patent application Ser. No. 14/829,800, filed 19 Aug. 2015, SIDE BETS FOR PLAYING CARD WAGERING EVENTS WITH OPTIONAL PROGRESSIVE EVENT.

BACKGROUND OF THE INVENTION

1. Field of the Invention

The present invention relates to the field of gaming, particularly to the field of card games (both physical and electronic) and particularly to the use of bets and side bets variations in games.

2. Background of the Art

The industry has attempted to use side bet and jackpot events to attract players to games and to keep players active in games for extended periods. It has been found to be extremely difficult to develop jackpot games for use with baccarat and blackjack that have a reasonable ability to develop large jackpots (e.g., over 100,000 wagering units, such as US dollars) and to provide a significant hit frequency with less than entire jackpots being awarded. Typically, jackpots identified with blackjack and baccarat games have maximum jackpot hit frequencies in the 1:50,000 range, so that jackpots rarely exceed 50,000 units. Particularly with networked games having many tables, low total jackpots do not attract as much play as jackpots in the 100,000 unit range (that is 100,000 times the amount of the side bet wager) and 500,000 range and even in excess of a million unit range. One reason for the inability of high jackpots to be reached is that all outcomes definable from three or four cards (the initial visible cards in blackjack and baccarat) occur with frequencies below the 1:50,000 range.

Published US Patent Application Document No. 20140309017 (LaDuca) discloses a method of playing a combined casino card game combining a standard casino card game with an optional In Between side bet that uses the same cards as played in the standard casino card game.

U.S. Pat. Nos. 8,926,421; 8,348,747; 8,147,316; and 7,758,411 and Published Applications Nos. 20060189365 (PokerTek) describe fully electronic tables with virtual playing cards, electronic wagering and even no live dealer. Multiple players have individual active screens displaying event outcomes and enabling wagers. U.S. Design Pat. No. D512,466 shows a table layout with individual player panels that individual player inputs on wagers and discards.

Published US Patent Application Documents Nos. 20120157193 and 20100130280 (Arezina) describe a multi-player gaming system that senses multiple simultaneous contacts on a surface of a gaming table, differentiating contacts by different players.

Other systems emphasize control of playing cards and reading playing card and hand ranks. Published US Patent Application Documents No. 20100019449 (Downs) describes a playing card delivery shoe is used in the play of the casino table card game of baccarat or blackjack or any game where cards are pulled one at a time from the shoe. The apparatus comprises a reader or an imager that scans lines bisecting the image at spaced intervals. Published US Patent Application Documents No. 20110275432 (Lutnick) describes an apparatus comprising: a machine readable medium having stored thereon a plurality of instructions that when executed causes a computing device to perform a method defining execution of a gaming event. Published US Patent Application Documents No. 20150087417 (George) describes a system for use in operating gaming tables within a gaming environment is described herein.

Published US Patent Application Document No. 20140370980 (Czyzewski) describes a gaming assemblies with a playing surface including at least one screen display. A system projects visual light on the screen display. A radiation source illuminates objects placed over the screen display.

A series of U.S. patents with a common inventor of Soltys (including by way of non-limiting examples, U.S. Pat. Nos. 7,575,234; 7,510,194; 7,427,234; 7,390,256; 7,317,615; 7,222,852; 7,011,309; 6,991,544; 6,964,612; 6,857,961; 6,758,751; 6,712,696; and 6,688,979) describes various components and methods attempting to configure and establish a more automated gaming table.

U.S. Pat. No. 8,915,786 (Baerlocher) discloses a plurality of simultaneously, substantially simultaneously or sequentially played primary games, wherein a designated triggering event in at least one of the games causes the gaming device to change, modify, supplement, add to, activate or otherwise influence the paytable of at least another game.

U.S. Pat. Nos. 8,613,650; 8,403,740; and U.S. Pat. No. 8,109,821 (Kovacs) provides a gaming system including a central controller, a central display which includes a plurality of display segments and a plurality player stations.

U.S. Pat. No. 8,333,657 (Nelson) describes a system that changes the focal point of a display device at different points in time to assist the player in focusing on different simultaneously or concurrently played games at different points in time.

U.S. Pat. No. 5,275,411 (Breeding) discloses a position of start indicator for Pai Gow poker games where a hand-position for first hands dealt is randomly indicated by a 7-segment display for positions 1-7.

It is desirable for the functional ability of the game table to contribute to specialty or carnival wagering games. In particular, these technologies (including those in the Related Applications data section, herein), when providing side bets for progressive jackpots using physical playing cards, may have variations in probabilities of winning outcomes as playing cards are exhausted, enabling some level of card counting to be used to determine advantages in gaming outcomes. All patent literature cited herein is incorporated by reference in its entirety herein.

SUMMARY OF THE INVENTION

A gaming system enables enhancement of wagering outcomes (e.g., in an underlying game, a side bet, a bonus event and/or a progressive jackpot) with: a) a gaming table having a game play surface for multiple players; b) a programmable electronic random number generator; c) a player input control at a player position; d) a display system capable of indicating a secondary random event outcome provided by the programmable electronic random number generator for each of the multiple players; and e) and the random number generator configured to control of a display of individual player position secondary random events determined by the random number generator. After a wager has been locked in, the secondary event generator provides the random secondary outcome, which is then displayed on the table and locked in. The secondary random event display should be locked in after any wagers (or most wagers) that can be affected by the secondary event. The secondary random event display should be locked in before the event outcome for the underlying game is completed to enhance interest.

A gaming system for enabling enhancement of wagering events, paytables and outcomes includes: a) a gaming table having a game play surface; b) a processor; c) a player input control at a player hand position at least enabling input of wagers (the player input control may be in communication with the processor); d) a random number generator configured to output at least two differentially weighted outcomes for display (which may be in communication with the processor); and e) a display system in communication with the random number generator for displaying the differentially weighted outcomes. The game play surface at the player hand position or a display separate from the game table but viewable from the player positions (e.g., a display screen or panel of lights near, above, behind the dealer position such as an elevated display) has display components (e.g., lights, bulbs, LED displays, liquid crystal displays, CRT displays, plasma displays, flip-panel displays, and any other visually determinable displays for symbols, numbers, figures, words and the like) that are at card-receiving positions at the player position, a power source in communication with the display components; the processor, in response to random selections of the differentially weighted outcomes at each (at least player) card-receiving positions, is configured to direct that a specific randomly weighted outcome is displayed, e.g., by closing an electrical connection, providing a specific image to be displayed at each player position, providing a template of arrays of lights/images etc. to be displayed at (or with a generally viewable display panel that indicates the random differentially weighted outcomes for each player position), or any other form of activating or providing direction for content to the display components for each player position. Lights or other display components may also be present at a dealer hand position to implement any event.

The gaming system may be used in a method and apparatus for hosting any game, whether on playing card tables, dice tables, roulette tables, big wheel tables, electronic gaming tables, physical gaming tables, and by virtual inclusion on an existing display system, on any gaming equipment having electronic components and electrical power (such as electronic gaming machines, hand-held wagering devices including smart phones with apps, smart televisions, etc.). The present application emphasizes the use of this technology on gaming tables using physical playing cards, but as noted above, the technology concepts are applicable to a broader range of gaming systems. Likewise, the present disclosure emphasizes application of the technology to playing card table games of blackjack, baccarat, poker (and variations of each of the games) with a player position in competition with or without a dealer position, but any other wagering game may benefit from the use of the present technology. Similarly, although physical playing cards are one method of implementation in conjunction with the present technology, virtual gaming object-providing systems (electronic tables, electronic gaming machines, etc.) may also be combined with the present technology. The player position and the banker position receiving (virtual or physical) playing cards from one or more (physical or virtual) decks of (typically at least 52) playing cards, the method comprising: performing a game or a side bet event during an underlying wagering event according to the present technology. The following are types of examples of effects and implementations on gaming that may be performed. Again, the use of playing cards (rather than virtual symbols, tiles, wheels, dice etc.) are emphasized, but without any intention to exclude the other gaming elements. The type of impact that the present technology may have at a gaming table includes at least:

a) The display components themselves providing an additional game outcome at each player position. For example, using a display component having (for example) four available displayable components and/or outcomes (e.g., 0, 1, 2 and 3), when a wager is made on the additional game, 0 (having a weighted probability of for example, 70%) would be a loss; 1 (having a weighted probability of 20%) would be a win at 3:2 odds; 2 (having a weighted probability of 8%) would pay 4:1; and 3 (having a weighted probability of 2%) would pay 5:1. This would be a house advantage of 28%. As the weighted probabilities should be programmable and preset before game play, the house advantage can be adjusted as can the frequency of events and the payout odds.

b) The display component may alter paytables on the underlying game (with or without a side bet). For example, some casinos have reduced payout odds on Blackjack to 6:5 from the traditional 3:2. These odds can be varied, still providing an improvement to the casino's house advantage (with respect to 3:2) by altering payouts by a weighted distribution between combinations of 1:1, 6:5, 3:2, 2:1, 3:1 an even higher. For example, using a display component having four available displayable components (e.g., 0, 1, 2 and 3), when a blackjack occurs, 0 (having a weighted probability of for example, 50%) would pay 6:5; 1 (having a weighted probability of 40%) would be a payout at 3:2 odds; 2 (having a weighted probability of 8%) would pay 2:1; and 3 (having a weighted probability of 2%) would pay 5:1. This would create an average payout of 1.46:1 which is less than 3:2 (providing a motivation of the casinos to use the game) and still offer close to traditional odds to a player. Again, the frequencies and payout odds may be varied to target a house advantage.

c) The alteration of the odds on an underlying game (as in b) may be made a condition of and/or result of placing a side bet on an event associated with the underlying game. As in the blackjack example of b), any position not placing a side bet could be paid at 6:5 for a blackjack. Any player position making the side bet would get both the increased odds on the blackjack (according to the weighted distributions, which could be advertised as statistically always greater than or equal to 6:5) and entry into a side bet event on the underlying game (in this case blackjack). The side bet event could be a simple bonus event (e.g., Lucky Ladies® side bet, Over-and-Under™ side bet, etc.) or could be part of a progressive jackpot event as later described.

d) As casinos resist the use of "specially-marked playing cards" for various reasons, the present technology can replace the special markings simply and efficiently. For example, in a 6-deck shoe, if there were a single Ace-of-Spades in the deck, that single card would have an appearance frequency of 1/312 playing cards played, while any Ace-of-Spades (including the marked card) would have an appearance frequency of 1/52 playing cards played. The same is true with a King-of-Spades and a Queen of Spades. To remove the special markings requirement, the probability of special marking events (independent of the playing cards) is frequency distributed by the random event outcomes (generically referred to in the art as secondary independent random event outcomes as they are not dependent upon the playing cards). Therefore, with the secondary, weighted probability random event outcomes occurring in the play of every hand at every player position (no display is in effect an event of 0) or at least every player position that makes a side bet wager (which is usually locked-in by the casino), the number of special markings is artificially created by the weighted probability random event outcomes occurring. For example, with "0" indicated as the weighted probability random event outcome occurring at a player position, there would be no specially marked cards. With "1" indicated as the weighted probability random event outcome occurring at a player position, there would be one specially marked card in the player hand at the position where the "1" appears. With "2" indicated as the weighted probability random event outcome occurring at a player position, there would be two specially marked cards in the player hand at the position where the "2" appears. With "3" indicated as the weighted probability random event outcome occurring at a player position, there would be three specially marked cards in the player hand at the position where the "3" appears. The frequency of the "special marking" can be programmed into the random number generator, with at least two probabilities of two random outcomes being unequally weighted. That is, the outcomes for four events could be any weighted probability totaling 100% except for 25%, 25%, 25% and 25%. As shown above, probabilities of 70%, 20%, 8% and 2% are differentially weighted, as could be 25%, 25%, 23% and 27%. Any number of outcomes could be available (e.g., 1000 differently weighted outcome), but for efficiency of the system and play of the games, between 2 and 100 outcomes is a good working target, with between 2 and 54 outcomes a strategic target for playing card games, between 2 and 20 outcomes being reasonable, but between 2-10, 2-8, 2-6, 2-5, and 2-4 outcomes being preferred.

e) The weighted probability random event outcomes occurring at a player position may be used to alter paytables (similar to b). For example, in Three-card Poker™ games, the paytables may alter (for example looking at only three-of-a-kind payouts) from 30:1 with no side bet wager, 35:1 with a single wagering unit side bet, 40:1 with 2 single unit side bet wagers, etc. The side bet wagers may also (and even preferably) alter payouts on more frequent underlying game outcomes (e.g., pairs, straights and flushes) as well as possibly entering that player position in an additional side bet event, including progressive events.

f) The weighted probabilities can determines if additional cards are available to a player (with or without additional payments by the player) or if one or more playing cards can be wild cards. The number or types of indications of the secondary random light events described herein can indicate zero, one or even two additional or replacement cards, or one two or even three wild cards (additionally or from among cards in the player's natural hand).

The following is a non-limiting example of a specific method and game content of play in a blackjack wagering event.

a) a player position provides a side bet wager to be determined by playing cards provided to the dealer hand position and/or the player hand position;

b) preferably, after the side bet wager has been placed and that side bet wager locked-in (preventing any further side bet wagers at that or any other player positions), the differentially weighted outcome generator provides directions and implements display of random signals at each player position (preferably) or only each player position where a side bet has been placed and locked-in;

c) two random playing cards are provided to a dealer hand position (typically with one card positioned face-up), and two random playing cards are provided to a player hand position face up;

d) resolving the side bet wager against a paytable which identifies a side bet event (e.g., for exemplification only) such as a spread (number of card ranks available between the two face-up cards) in a player hand(s) on which the side bet wager has been placed, or an industry standard side bet as in Twenty-One plus Three, 21+3, three-card poker event;

e) providing a third random card (or third and fourth random card in baccarat) as either i) a card, such as separately provided playing card dealt to the table or ii) using a dealer single up-card (or banker two cards in baccarat) as a side bet event card on which the side bet wager has been placed; and f) resolving the side bet wager against a paytable on a basis of the game (e.g., three-card Poker™ game) or whether the third (or third and fourth) random card has a rank (or point count when 10, J, Q and K are all zero-county or ten-count playing cards) within the spread and size of the original spread determined by the two player cards. In baccarat either or both the player hand and the Banker hand may be used to determine a spread;

By using randomly generated images or lights on the display components to identify rarified playing cards (the functional equivalent in the practice of the present technology of specially marked cards), a side bet progressive game can be constructed in which jackpots statistically can grow to levels above one million dollars, without likelihood of extreme variation in advantages or probabilities because of exhausted "specially marked cards." Where, for example, four differentially weighted outcomes are available, For example, the probability of a specific same suited (spades) A-K-Q appearing in the combination of the dealer hand up-card and the two player position up-cards is approximately 3/52×2/52×1/52 or approximately 24,000/1. For any same suited A-K-Q under these conditions. The probability is approximately 6,000/1. Because of additional payout event, the payout odds on these events would likely be 110/1 and 30/1, respectively. For a progressive event in combination with these side bet payout event, the progressive accumulations (50% of side bets) less some intermediate jackpot payouts would be slow and the total amounts for the progressive jackpots would be relatively small (e.g., approximately $2,000 total average jackpot). By using the present weighted random event display at each player position, the average jackpot payout could be increased (or maintained) to whatever level is desired. For example, by paying 0% for the lowest of four secondary random events with a probability of 70%, 5% for the next higher of four secondary random events with a probability of 20%, 10% for the next higher of four secondary random events with a probability of 8%, and 100% for the highest of the four secondary random events, the average 100% progressive jackpot will now be over $500,000 with the same house advantage. By altering the frequencies of the secondary random events and the numbers of playing cards (from three cards in blackjack to four cards in baccarat), the jackpots in a progressive event can be statistically designed to average between $2,000 and $15,000,000 using the technology of the present invention.

BRIEF DESCRIPTION OF THE FIGURES

FIG. 2 shows a panel used on a gaming table to show exhaustion of critical marked cards used in the progressive event.

FIG. 4B shows quadrant 4B of the schematic of FIG. 4.

DETAILED DESCRIPTION OF THE INVENTION

Figure 1:
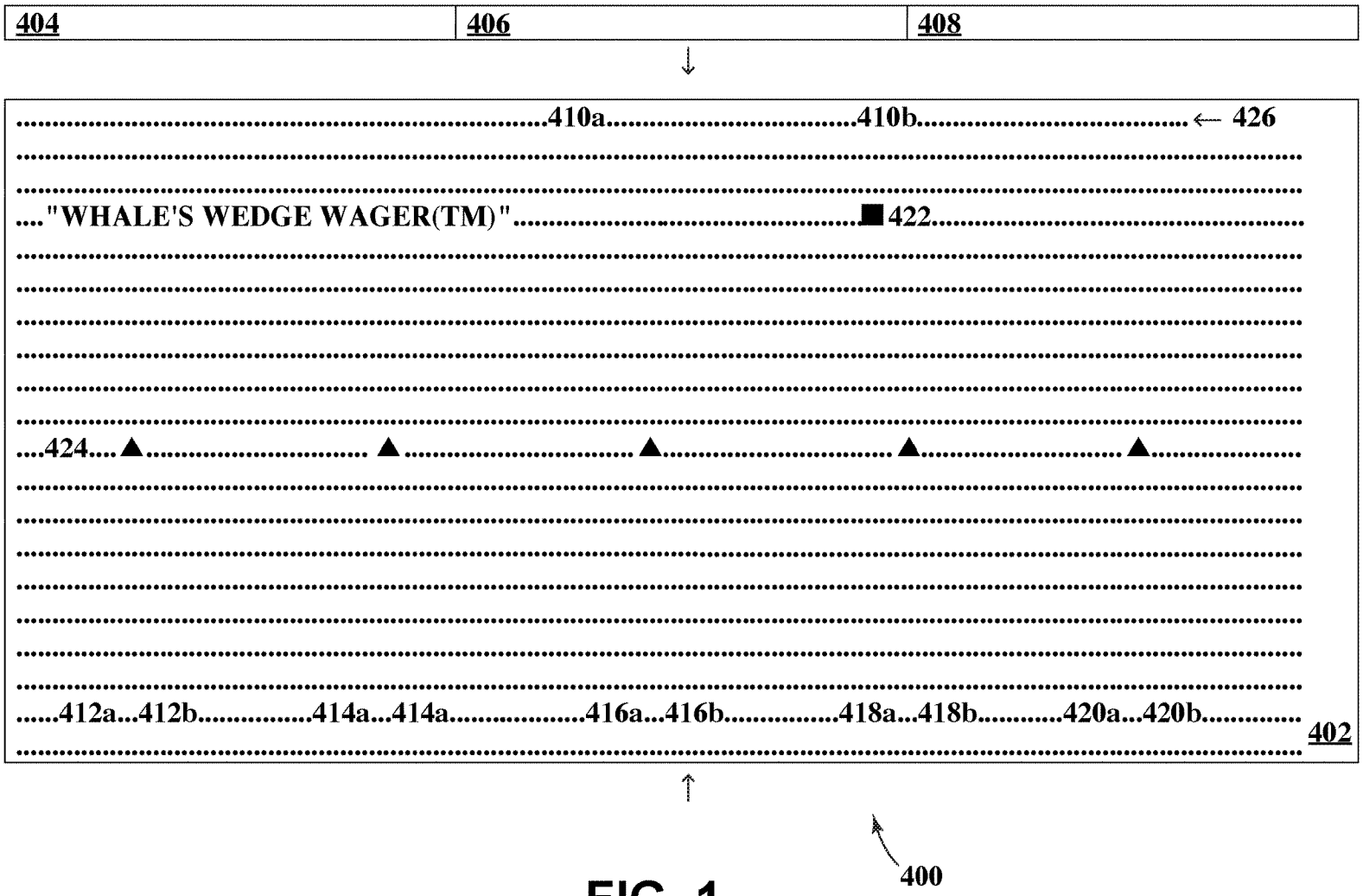
FIG. 1 shows an electronic gaming table on which the gaming method may be executed.

As noted above, when physical playing cards are used, especially with the use of a limited number of unique playing cards to be used in a jackpot or progressive jackpot event, the unique (such as specially marked playing cards) cards can be observed by players to become exhausted or become richer in remaining cards, which could significantly alter playing strategy and advantages/disadvantages with respect to the progressive jackpot. For example, in a game described herein a 6- or 8-deck shoe of 52-card decks of physical playing cards is used, with, for example, three specific cards (by suit and rank) specifically marked (e.g., Ace of spades, King of spades and Queen of spades are used as a non-limiting example) are used to define a 100% winning outcome for the progressive jackpot. In using physical playing cards to implement the outcome, the specially marked unique playing cards can be observed to become significantly richer or exhausted during play. For example, if there were a single round of play of blackjack with six players at a table, and no specially marked Ace, King or Queen of spades occurred with 22 other cards used in the round of play (including the dealer position cards), the probability of the specially marked cards become at least 5% richer in the remaining set of playing cards, increasing the likelihood of a winning outcome for at least a portion of the progressive jackpot. Similarly, if one, two or three of the specially marked playing cards are displayed in the first round(s), the probability of a 100% jackpot winning event can be decreased by as much as 50% or even completely eliminated (e.g., both Aces of spades where there are only two-each of the specially marked A-K-Q of spades set). Even though a continuous shuffler can be used to dramatically reduce this impact, players may still estimate that replacement cards will not be placed into the front of the remaining set of cards and adjust wagering accordingly. This partial knowledge of distribution is disadvantageous to the operation of the wagering event. The present technology offers apparatus and systems and methods that technically improve the operation of the wagering event and other wagering events where special outcomes are to be evidenced on the gaming table and reduce the exhaustion factor of specially marked cards.

A gaming system for enabling enhancement of wagering outcomes is provided with at least: a) a gaming table having a game play surface; b) a processor; c) a player input control at a player position, the player input control being in communication with the processor; and d) a random number generator in communication with the processor. The game play surface at the player position has lights (and optionally a vibrator or audio component for visually-impaired players) that are at card-receiving positions at the player position. A power source in (opened and/or closed) communication with the lights. The processor, in response to random selections of the card-receiving positions at the player position, is configured to direct that a (for example, closed electrical) connection occur between the power source and the lights at the player position so that the lights are randomly lit at at least the player card-receiving position(s)/There may also be lights in communication with the power source at a dealer card-receiving position and the processor, and in response to independent random selections of the card-receiving position at the player position, t processor is configured to direct that a closed electrical connection occur between the power source and the lights at the dealer position. In this way, there is randomly provided lighting at card-receiving positions at player hand positions and dealer hand positions. By using the random lighting at these positions on gaming tables with physical playing cards, the use of actual physically marked or specially marked playing cards can be eliminated. Any one of the unique cards is now provided by the presence of that card in combination with the random lighting at that playing card position. In this manner, with exhaustion of cards in the original set, including the suit and/or rank cards used in a progressive jackpot event (in both blackjack and baccarat, there is a "cut" into the original set so that all cards are never exhausted) are less dramatically diminished or made rich during play. The variation in exhaustion is reduced by at least about 30% (on average) and the variation in richness is reduced by at least about 10% (on average). This gaming system therefore addresses and solves a specific technical issue in gaming technology.

The system also offers a possibility of a separate payout event, either on the underlying wager of the side bet. When one, two, three or four of the playing card positions are randomly lit (with or without the specific ranks of cards used in the preferred progressive playing card jackpot wagering event), an additional payout may be provided, such as 10 wagering units for a single light, 20 wagering units for two lights and 100 wagering units for three or more lights. The term wagering unit is used to identify the amount actually wagered and the units (cents, quarters, dollars, Yuan, Euros, etc.) used as the amount and currency of the wager. The gaming system includes a source of random physical playing cards on the gaming table for delivery of random physical playing cards to the card-receiving positions at the player position and preferably also the dealer position. The gaming system may have the source of random physical playing cards associated with a card-reading component that recognizes at least one of card suit and rank and reports that recognized at least one of suit and rank to the processor for each card-receiving position. The gaming system enables the lights to be controlled between at least an on-off set of conditions (the lights may also be enabled to flash or for unique colors to be provided) e.g., by circuitry which, in effect, gives direction that an effectively closed electrical connection occurs between the power source and the lights at the player position, which may be provided independent of recognition of the at least one of suit and rank delivered to the card-receiving positions, or which is provided dependently on recognition of the at least one of suit and rank delivered to the card-receiving positions, with the random number generator activated upon recognition of physical playing cards at card-receiving positions at the player position with specific at least one of suit and rank. For example, at player card-receiving position No. 1, the random number generator may have a range of probabilities for all cards delivered to that position to be lit at a frequency of between 1:1.1 to 1:100 or to 1:25 (as an example of available ranges). At player card-receiving position No. 2, the random number generator may have a range of probabilities for all cards delivered to that position to be lit at a frequency of between 1:1.2 to 1:30 (as an example of available ranges, which do not have to be identical to the range or absolute probability for position No. 1). At dealer card-receiving position No. 1a, at player card-receiving position No. 1, the random number generator may have a range of probabilities for all cards delivered to that position to be lit at a frequency of between 1:3.1 to 1:35 (as an example of available ranges, again which do not have to be identical to the range or absolute probability for positions No. 1 or No. 2). By varying the mapped probability for each and all positions, the average size of the jackpot, the probability of each potential winning outcome, such as 5%, 10% or 100% of the progressive jackpot, can be controlled for the long-term by the system. As with the use of physically marked special cards (with three positioned cards used, such as A-Q of spades in the player two-card hand and the K of Spades in the single dealer up-card), a frequency of 1:8 for each position would be the equivalent of one set of three specially marked cards and a frequency of 1:4 for each position would be the equivalent of two sets of three specially marked cards. Using different probabilities for each position would be the equivalent of using different numbers of each of the three specially marked cards, but without requiring special marking on the physical playing cards.

A method of performing a side bet wagering event on the gaming system described herein during a playing card wagering event in which any number of random physical playing cards are dealt (manually, automatically or virtually), and especially where exactly three physical playing cards or exactly four physical playing cards are exposed without any game play strategy or additional cards being provided during play of the playing card wagering event may include:

a) the player position providing a side bet wager to be determined by playing cards provided to at least one of a dealer hand position and the player hand position;

b) providing a specific number (e.g., one, two, three, four, five or more, but with two being used in the non-limiting example) two random physical playing cards to a dealer hand position, and providing two random physical playing cards to the player hand position (e.g., one, two, three, four, five or more, but with two being used in the non-limiting example), wherein if only one dealer random physical playing card is initially provided face-up, exactly three random physical playing cards are used in determining outcomes in the physical playing card wagering event, and if both dealer hand random physical playing cards are dealt face-up, then four random physical playing cards provided are used in determining outcomes in the playing card wagering event;

c) determining the spread between the two random physical playing cards in a hand on which the side bet wager has been placed;

d) determining whether the side bet has been lost because of a spread of zero between the two random physical playing cards in the hand on which the side bet wager has been placed;

e) upon determining that there is a spread in excess of zero between the two random physical playing cards in the hand on which the side bet wager has been placed, the player position hand and uses a third playing card which appears in a position selected from the group consisting of a dealer position card, a player position third playing card, a community card, and a randomly displayed image of a card to determine if the third card lies within the spread in excess of zero to resolve the side bet;

f) determining if the third playing card is within or not within the spread; and g) resolving the side bet wager against a paytable which identifies odds dependent on the spread determined in e) based upon the determination whether the third playing card is within or not within the spread;

wherein at least a portion of the side bet wager, but less than all of the side bet wager is contributed to a progressive jackpot, the amount of which is stored, incremented and decremented in a processor, decrementing being based in-part upon resolution of the side bet for outcomes where percentages of a total in the progressive jackpot are awarded for defined random event outcomes when the third playing card is within the spread, and the processor sends a signal to a display screen available for view at the player position indicating status of the jackpot amount.

The method may require the display of exactly and only three random physical playing cards (or even best five-of-six poker hand with two three-card poker hands) to determine an outcome in the progressive jackpot side bet and the method is performed on the gaming table and the side bet wager is provided through an electronic wagering input device at the player position on the gaming table to the processor, and the input device communicates location of a player position at which a side bet wager has been placed and an amount of the side bet wager to the processor. The processor preferably transfers a portion of at least 5% and less than 60% of the side bet wager into a progressive jackpot account monitored by the processor and the processor causes a display to visually indicate an available balance in the progressive jackpot. The method may provide a highest payout from the progressive jackpot within comprises the third physical random playing card being a suited rank card within a spread created by two of the same suited playing cards that provide a spread of one at the position at which a side bet wager has been placed and an amount of the side bet wager to a processor and the card-receiving position for each of the random physical playing cards is lit by lights at the card-receiving positions by random selection by the random number generator communicated to the processor. The method may also provide a highest and proportional amount of the progressive jackpot with any preselected specific suit and rank cards (e.g., 1, 2, 3, 4, 5, or 6 cards) without any ordering, if they are provided and then randomly lit to provide the defined combination of numbers of cards, ranks, suits and/or lighted cards according to a paytable. For example, the probability of the random lighting may be 1:50, so that the random lighting on four card positions, without reference to suit and rank of playing cards, would provide a frequency of the 100% winning outcome at 1:6,250,000, which would roughly provide an average jackpot size (including for example, 5%, 10% and 20% withdrawals from intermediate 1-lit card, 2-lit cards, and 3-lit cards) of about 2 million wagering units. This would also provide intermediate payouts of 50, 2500, and 125,000 units. If the maximum payout were for three of four card positions (e.g., baccarat) being lit, without reference to the playing cards, with a 20% house advantage, the payouts would likely be about 15-25 for a single light, 500-1,200 for two lights, and 10,000 to 50,000 for three lights.

In a three-card initial display wagering event (e.g., the two player cards and the dealer up-card or player three cards), a lights only event might have a light frequency of 1-10 to 1 to 200 for each position. This would enable maximum payouts at a frequency of about 1:8,000,000 for the 1:200 predetermined light frequency. The average payout for intermediate lights only hits, with no particular rank or suit required could be 20-50:1 for one light, 200-1000:1 for two lights and 500,000 to 2 million (or higher) for three lights at this 1:200 frequency. These parameters are completely in control of the designer using the enabling unique gaming system of the present technology. Rather than specific suits and ranks, general ranks may be used (e.g., any J-Q-K) along with the lighting factor or just specific suits (three spades for 100% jackpot with three lights, three hearts for 50% jackpot with three lights, three diamonds for 25% of the jackpot with three lights, and 10% for three clubs with three lights). The lighting offers a level, parameter, dimension of control over the odds, frequencies and payout amounts and rates not heretofore seen in the industry, without requiring the use of specifically marked playing cards.

The highest payout from the progressive jackpot may include the third random physical playing card being a suited rank card within a spread created by two of the same suited playing cards that provide a spread of one at the position at which a side bet wager has been placed and an amount of the side bet wager to a processor and at least one of the three cards has a bonus indicator provided by the light at the card-receiving position for at least the suited ranked physical playing card for the side bet to win 100% of the jackpot. Any other card combination may be used. Three card poker ranks, for example may be used in combination with a requirement of 1, 2 or 3 lights being randomly provided for those three playing cards, or the player and dealer three-card hands may be combined for best-of-five poker hand out of the six cards (e.g., 3-card player hand and 3-card dealer hand). The method may require that the two cards defining a spread in the side bet are placed at a location adjacent the position at which a side bet wager has been placed, and the third card is placed between and/or at the bottom of the two random cards at the position at which a side bet wager has been placed.

The method may require the use of playing cards as physical playing cards provided from an electromechanical device providing one or more random physical playing cards for manual delivery to a distinct player hand physical position on a gaming table and a distinct dealer hand position on the gaming table. The various lighting parameters discussed above may be used with these playing cards. It is preferred that the two random physical playing cards define a spread in the side bet are placed at a location adjacent the position at which a side bet wager has been placed, and the third random physical playing card is placed at a distinct location that is different from the position at which a side bet wager has been placed.

Reference to the Figures may provide additional understanding of the present technology.

FIG. 1 shows a gaming table system 400 with a game play surface 402. A set of electronic components of processor 406, random number generator 404 and progressive jackpot display 408 are shown in one-way or two-way communication with the game play surface 402. On the game play surface 402 are shown two dealer card-receiving positions 410*a* 410*b*, and five (5) sets of two-card player card-receiving positions 412*a*-412*b*, 414*a*-414*b*, 416*a*-416*b*, 418*a*-418*b* and 420*a*-420*b*> There are rows of lights or pixels (e.g., lights provided by bulbs, semiconductors, liquid crystals, LEDs or any other light emitting structure) 426 on the game play surface 402. The individual light emitters may be analog or digital and may be evenly distributed across the game play surface 402 or located (only or in part) immediately about the card-receiving locations (e.g., all of 410*a*-420*b*, inclusive). The processor, executing the function or receiving information from the random number generator (RNG) 404 causes random sets of the lights about the various card-receiving positions (both player and dealer/banker or only player or only dealer) to randomly be lit at the frequency determined by the RNG 404. A shuffler providing the random physical playing cards is shown as 422. Special wagering positions, credit acceptors, side bet entry and/or verification of the presence of the side bet for each player position may be shown by elements 424 which may, for example, be a D.E.Q. (e.g., G3 Platinum™ system) progressive wager input control. Upon the processor indicating to the game play surface that lighting is to be provided at a card-receiving position, lights or pixels in the rows (e.g., 426) adjacent and surrounding (e.g., combinations of ones to the left, right, above and/or below) the card-receiving position are lit to a degree to clearly indicate to an observer (dealer, player and/or by-stander) that a potential jackpot event is in play or any bonus event provided by the side bet wagering event.

The display of the lit areas, must of course be locked in to individual positions after the side bet has been received and further wagers on the side bet have been locked out. The processor will refuse to recognize any further side bet wagers through any component, such as 424 once this lock-out is in place.

A preferred method and apparatus for hosting a modified game of blackjack or baccarat with a player position in competition with a dealer position. The modification includes a side bet as defined herein. The player position and the banker position receiving playing cards from one or more decks of 52 playing cards, as a standard first step in the play of blackjack or baccarat. The dealer may still have one card face-down when first delivered in blackjack. The players' cards are placed face up, and it is desirable if the cards are physically placed on the table with a space between them. The order and position of placement in two spots is not material, but for reasons provided herein, some separation or placement of the player position cards adjacent to each other is desirable.

After the cards are dealt in the blackjack or baccarat event, the cards are viewed and the "spread" determined. The term spread as defined as the space or number of spaces between the two cards on which the wager is placed. For example, the following cards exemplify a spread produced by those cards:

| Cards | Spread | Cards | Spread |
|---|---|---|---|
| Ace and 2 | 0 or 11 | Pairs or 10-value cards | 0 |
| Ace and 3 | 1 or 10 | Ace and 10-value card | 0 |
| Ace and 4 | 2 or 9 | 2 and 10-value card | 7 |
| Ace and 5 | 3 or 8 | 3 and 10-value card | 6 |
| Ace and 6 | 4 or 7 | 4 and 10-value card | 5 |
| Ace and 7 | 5 or 6 | 5 and 10-value card | 4 |
| Ace and 8 | 6 or 5 | 6 and 10-value card | 3 |
| Ace and 9 | 7 or 4 | 7 and 10-value card | 2 |
| Ace and 10-value card | 8 or 0 (3, 2 or 1) | 8 and 10-value card | 1 |

As can be seen, the spread relates to the number of card ranks that are available between the two cards on which the side bet wager has been placed. The Aces and 10-value cards may be used in various formats adjusting payout odds in the practice of the wagering event of the present technology. The variations may be used to adjust the house advantage, game volatility and the odds in the paytable. For example, the house advantage may be increased and other payout odds increased and the game simplified by all 10-value cards being considered as a single rank, as opposed to an ascending order of 10, Jack, Queen and King. In the baccarat variation, the 10, Jack, Queen and King may maintain a zero value and be at the bottom of the count ladder, so that there is no spread between the ten-value (zero value in baccarat) cards and aces, and a spread of 1 between the zero value cards and a 2. Also, for purposes of the side bet, the Ace may be considered only a 1-value in baccarat, or only an 11-value in blackjack (except for the jackpot event as described herein), or the value (solely for the purposes of the side bet) be the value that creates the smallest spread with the other card. If there is a progressive component in the side bet, a paytable may be structured as follows, with the unique events described in further detail later herein.

A unique event pays 100% of the progressive jackpot. Lesser events may have payouts of from 5%-25 of the jackpot (for example). Other event outcomes may have specific odds as already indicated in the table above, or even lower or higher odds to accommodate the amount contributed to the jackpot. One unique aspect of the content of the game is the identification of a specific three-card combination as the "unique event." Any specific three-card combination may be selected, but for convenience the construction of same-suited Ace-2-3 will be considered. For example, the unique three-card combination that wins 100% of the progressive jackpot may be only the A-2-3 of a specific suit, such as spades. The jackpot may be further qualified in the winning event only when the Ace spades and 3 of spades are the first two cards and the 2 of spades is the third card. As multiple decks of playing cards are used, the probability of the maximum unique event may be further limited by designating only a limited number of the Aces of spades, 2 of spades and 3 of spades may be specially marked (e.g., the casino name) and the 100% jackpot may be paid only when at least one of the three cards in the unique event must be present for the 100% jackpot to be awarded. For example, in an 8-deck blackjack shoe, fewer than all of at least the Aces of spades (or alternatively the 2's of spades and/or 3's of spades) may be marked with the special bonus symbol. For example, in the 8-deck shoe, where there are eight Aces of spaces, only 7, only 6, only, 5, only 4, only 3, only 2 or only 1 may have the special jackpot or bonus marking. The marking may be performed on only one, only two or all three of the unique event cards may be marked, and less than all of one, two or three of cards may be used. The use of multiple ones of the marked cards and less than all of the marked card (or cards) offers the advantage of not dissuading players to avoid the side bet because an only necessary card has already been played, eliminating the possibility of any player obtaining the 100% payout on the jackpot. The use of a continuous shuffler (where all cards are returned to the shuffler after each round of play, and the returned cards are randomly inserted into the residual set of playing cards in the shuffler) partially eliminates that issue from the players. These alternatives provide significant control over the events in the jackpot events of the jackpot wagering. For example, if all three specially marked cards in the sequence are needed for 100% jackpot, the difference in probability going from 8 of each card (Ace of spades, etc.) being functional in the 100% jackpot down to only one of each of the cards in the unique event being marked can change the probability of that event occurring by more than 100-fold. The use of non-marked equivalent cards in the unique event (e.g., Aces of spades without the special mark) also adds to the availability of smaller, but significant jackpot payments. For example, if the specially marked A-2-3 of spades (or any other suit) is needed for the 100% jackpot payout, combinations (of A-2-3 of spades) for example with only one of the specialty cards (e.g., a specific one card or any card) may pay 5-10% of the jackpot and combinations (A-2-3 of spades) with two marked cards may pay 10-25% of the jackpot. This shows the flexibility of the wagering event.

Certain jurisdictions may have regulations that require that the largest available jackpot winning outcome must be available for that wager to be allowed. For example, in the event that a uniquely marked Ace, uniquely marked 2 and uniquely marked 3 are required for the final 100% jackpot winning event, in theory, once all of the specially marked cards of a single value are exhausted from tan original set (shoe) of playing cards, the side bet wager might no longer meet regulations. This can be addressed in numerous manners. As noted elsewhere, a continuous shuffler may be used so that all recently used cards are immediately returned to the set of playing cards. Alternatively, with card reading delivery shoes and card-reading shufflers, the processor can be configured to determine when all of at least one essential specially marked card (from the set of three or set of at least two specific cards) has been exhausted from the set of available random playing cards. For example, if a specially marked Ace of spades is needed for the 100% jackpot, and there were four marked Aces of spades out of a six-deck show, once all four of the marked Aces of spades have been used, the shoe/shuffler is shut down and a new set of playing cards provided. An alert notice can be provided by an alphanumeric display on the delivery shoe or shuffler, or a special alert bulb or alarm can be provided. The card set would be replaced immediately after the last available necessary specialty card was provided. Where at least two cards with jackpot specialty marks are needed for the Jackpot (e.g., at least two of the Ace-2-3 same suited cards must have the specialty marks), all three cards may be tacked by the card-reading shoe or shuffler, and when two of the three ranks of cards have been exhausted, then the notice, alert or alarm would be provided.

FIG. 2 shows a panel 250 with three distinct columns 252*a*, 252*b* and 252*c* indicating, respectively, remaining numbers of specially marked Aces of Spades, 2 of Spades and 3 of Spades. The panel may also be provided as a marked area controlled by a live dealer, who moves a marker or lamer from positions within the panel 250 to indicate exhaustion of critical cards. As shown in FIG. 2, there are spaces in the panel 250 indicating availability of four (4) of each of the specially marked cards critical to winning outcomes that award percentages (e.g., 5%, 10%, 15%, 20%, 25% or 100%) of the total jackpot accumulated. As shown in the FIG. 2, spaces have markers that indicate remaining numbers of critical cards of specific rank by a symbol e.g., Φ 254*a* indicating there are three of four original specially marked Aces of Spades cards. The panel may have only indications of three critical cards and marked appropriately. In the panels, the O's are neutral marks or spaces where lammers or markers may be placed. In FIG. 2, the position of the markers Φ 254*b* indicates four available 2 of Spades and Φ 254*c* indicates two available 3 of Spades. In this way, legal compliance may be observed and information provided to players. It is not necessary to make such indications on electronic gaming machines where new sets of playing cards (e.g., in increasing order of preference, a single deck, two decks, four decks, sic decks, eight decks, etc.) are provided at the beginning of each round of play. Numbers of each of the specialty cards may be varied to further control the odds in the electronic systems. Numbers of specially marked cards may even be varied according to the time of day to weight probability of a win so that larger numbers of people may be available to observe a major win. For example, the normal level of three or four specially marked cards of each critical card (generally exemplified as the Ace of Spades, 2 of Spades and 3 of Spades, although other combinations may be used, especially where the dealer position up card is used as the random third card) may be four cards in eight decks, and the reduced (but still legally allowable) frequency at different times of play may be three of each (or fewer than all, such as only 2's of Spades) specially marked card or even two of each (or less than all, such as only Aces of Spades and 3 of Spades) to reduce the probability of each major percentage win from the progressive jackpot.

As has and will be particularly indicated, many variations within the disclosure of this technology are available. For purposes of examples, A-2-3 or A-K-Q of same suited and specially marked cards have been particularly indicated. These are exemplary but arbitrary specific ranks as the use of spades and hearts in the discussion are arbitrary suits for the unique percentage jackpot awards. As within different cultures, different numbers can have different connotations, such as 4 and 8 in certain Pacific Rim cultures, the unique card combinations and outcomes may include these emotive cards in the jackpot events. For example, the spread may be determined by ranks of 3 and 5 (so that the 4-value card is the wedge card), 7 and 9 rank cards (so that the 8-value card is the wedge card) or 6 and 8 rank cards so that a 7-rank card is the wedge card. Any designated card, even cards without a single spread range may be used. For example, if the jackpot winning event is arbitrarily selected as 2-4-6, or Ace-3-5, or 2-4-8, or 4-8-King, those cards may be specially marked in a selected suit or even combination of suits, and the appearance of the outermost spread defining cards, 2-6, Ace-5, 2-8 and 4-King, respectively, makes the jackpot percentage award available. The only drawback with some of these variations is potential confusion if a filling card other than the bonus card is provided, or if different suits are used in the percentage jackpot awards, the determination of the final outcome is more confusing and time consuming. The use of a single suited event and a spread of any combination of cards with a single rank between them is the simplest and least confusing event.

In baccarat side bet events, similar considerations may be used. In a two-card spread baccarat game, for example, the spread hand (in either the player hand position or the banker hand position, by design or by allowance of either position with the side bet) may be the Ace and 4-rank of the same identified suit, and the winning wedge hand will be both the 2-rank and 3-rank cards of the same suit and preferably also the special markings on at least one, two, three or four of those cards. The order of the rankings and distribution of the rankings should be maintained as a split event to keep the feel of the Acey-Deucy type game and for ease of resolution and control of the probabilities. For example, the presence of A-4 in one hand and 2-3 in the other hand is much less likely than the appearance of all four of A-2-3-4 in both hands without consideration of distribution. That format could be used, but that would cause the jackpot event to have lower totals because of more rapid payouts. The payouts could also be made more frequent or otherwise adjusted by having a 5% payout for one specially marked card, 10% for two specially marked cards, 20% for three specially marked cards and 100% for four specially marked critical cards. To control the frequency of payouts and jackpot rate of growth in baccarat, a higher frequency of specially marked cards may be needed for 100% jackpots to be paid out. For example, in the blackjack variant of the side bet wedge event, it is believed that three or four specially marked cards provides a desired balance between frequency of payouts of percentages of the jackpot and rate of growth and size of the jackpot. In the baccarat variant, because two filling same-suited, specially marked cards must form the wedge event (as opposed to one filling card) the frequency of the event is reduced. It is therefore felt that four, five or even six specially marked ones of the same-suited critical cards is more desirable. This will increase the frequency of the smaller jackpot payouts, and their size may be accordingly lowered to keep the rate of growth of the 100% jackpot amount higher. For example, the one specially marked card successful wedge event may pay 2-4%, the two specially marked card successful event may pay 3-7%, the three specially marked card successful wedge event may pay from 7-15% and the four specially marked card successful wedge event (e.g., 1-4 in one hand and 2-3 in the other hand) would pay 100%. Again, the selection of rank and suite can be varied. The winning combinations can be hand distributions of 2-5 and 3-4, 3-6 and 4-5, 10-K and J-Q, J-Ace and K-Q and the like. Again, it is simplest if the spread is kept at two ranks and the edge must fill exactly the two same-suited cards within those rankings, with at least one specially marked card present.

The paytable for the four-card baccarat wedge event must be significantly different from the blackjack paytable. Spreads of one may also be "dead hands" in the baccarat game as only a specific rank pair can be between both cards. This could also be a high payout award. For example, where the spread hand is 3-5, the wedge hand of 4-4 might pay 25:1. It is desirable to require that both wedge hand cards fall within the split for simplicity, although there might be small award odds for single cards. Requiring both wedge hand cards to fill the spread will create much higher volatility, with much higher odds available. It is also likely that each of 10, Jack, Queen and King will be) value cards and of equal rank in play, as this comports with play in baccarat. An exemplary range of payouts for the wedge side bet be:

| Spread | Two Card Wedge Fill |
|---|---|
| 1 | 10:1 to 50:1 |
| 2 | 8:1 to 25:1 |
| 3 | 4:1 to 20:1 |
| 4 | 3:1 to 12:1; or 0:1, 1:1 or 2:1 |
| 5 | 3:1 to 5:1; 1:1, 2:1 or 0:1 loss |
| 6 | 2:1 to 4:1 or 0:1 loss to 1:1 |
| 7-8 | 1:1 or 0:1 loss |

The odds may be varied outside these ranges. Joker(s) cards may also be used as null special cards with different payouts or payout multipliers. Payouts in excess of 10:1, 15:1 or 20:1 may or may not be decremented from the jackpot.

In electronic gaming, video gaming, on-line gaming and the like, many of the above problems associated with depletion of critical specially marked cards become trivial. Multiple decks may be used with a single specialty marked card for one, two or three of the unique event cards, and new virtual sets of cards may be provided at the beginning of each round of play.

The method generally may have steps of: performing a side bet event during a blackjack or baccarat wagering event according to the present technology (the side bet amount may be any minimum amount, such as $1.00 or may be in amounts up to the table minimum or maximum), and the steps includes:

a) a player position providing a side bet wager to be determined by playing cards provided to the dealer hand (banker hand position in baccarat) position and/or the player hand position; (the wager may be placed on the player hand, a dealer hand or even a dummy hand as later described. As explained, there are advantages to each option.) The dealer position up-card may be best used as the card indicating whether the spread in the player hand is filled. That is because the play of the underlying game is not affected, and the side bet game is immediately resolved. Tension is still provided by waiting to see the dealer up card. The use of the player hand in the side bet wager assures the likelihood of only a single winner. The use of the dealer hand in the side bet wager would assure that all players entering the jackpot event at a single table would share the jackpot if won. If a dummy hand is used at the end of game play (receiving a required third card for the split or fill wager side bet event), two cards are dealt to the dummy position and a third card dealt to determine the event outcome, players will not feel that any actions done by intermediate players are affecting their own chances of game events. This method would also assure that all players entering the jackpot event at a single table would share the jackpot if won.

b) providing two random playing cards to a dealer hand position, and providing two random playing cards to a player hand position face up; (Placement of the cards can have significance for security issues, so that a third card is not intentionally or accidentally confused with one of the original cards dealt to the position on which the side bet wager has been placed. The cards may be placed adjacent each other (with no space between them, and the third card placed overlapping a lower portion of both playing cards. The cards may also be placed on two spaces specifically marked or generally positioned for receiving the first two cards, with the space between them marked or sufficiently wide that placement of the third card should be clearly distinguished from the other cards. The dealer position may also have the first two cards (even with one face-down) similarly positioned when the third card (if any) is delivered to the dealer position.

c) providing a third random card to the hand(s) on which the side bet wager has been placed; and d) resolving the side bet wager against a paytable on a basis of whether the third random card has a rank within the spread and size of the original spread.

A non-limiting example of a paytable for the side bet wager (without a progressive event) may be as follows:

| SPREAD | PAYOUT ODDS |
|---|---|
| 1 | 8:1 to 12:1 or 10:1 to 15:1 |
| 2 | 5:1 to 6:1 6:1 to 8:1 |
| 3 | 3:1 to 4:1 4:1-6:1 |
| 4 | 1:1 to 2:1 2:1 to 4:1 |
| 5 | 1:1 to 2:1 2:1 to 3:1 |
| 6 | 1:1 to 2:1 2:1 |
| 7 or more | 1:1 1:1 |

The exact math and an alternative paytable for the progressive jackpot side bet events (without including jackpot payouts) may be:

| Event | # (Event) | P (Event) | Odds (1-n) | Payout (n:1) | Value |
|---|---|---|---|---|---|
| Pair, no spread | 10,426,176 | 0.14587581 | 6.86 | 0 | 0.00000000 |
| Ace + ten value, no spread | 3,391,488 | 0.04745134 | 21.07 | 0 | 0.00000000 |
| One gap, no spread | 10,174,464 | 0.14235403 | 7.02 | 0 | 0.00000000 |
| Loss | 34,635,776 | 0.48459971 | 2.06 | 0 | 0.00000000 |
| Win, spread 1 | 720,896 | 0.01008628 | 99.14 | 10 | 0.10086280 |
| Win, spread 2 | 1,310,720 | 0.01833868 | 54.53 | 5 | 0.09169340 |
| Win, spread 3 | 1,769,472 | 0.02475722 | 40.39 | 4 | 0.09902888 |
| Win, spread 4 | 2,097,152 | 0.02934189 | 34.08 | 2 | 0.05868378 |
| Win, spread 5 | 2,293,760 | 0.03209270 | 31.16 | 1 | 0.03209270 |
| Win, spread 6 | 2,359,296 | 0.03300963 | 30.29 | 1 | 0.03300963 |
| Win, spread 7 | 2,293,760 | 0.03209270 | 31.16 | 1 | 0.03209270 |
| Win, spread 8 | 0 | 0.00000000 | 0 | 0 | 0.00000000 |

These numbers were derived from computer-generated outputs simulating 71,472,960 rounds of dealing and provided a player return of 44.75% and a house advantage (on the underlying play, which does not include the jackpot) of 55.25%. By contributing, for example, 35% of all side bet wagers to the jackpot, there would be a residual house advantage of 20.25%. There may also be a side bet progressive component, with a portion of the side bet wager being automatically contributed to a progressive jackpot. Anywhere from 10% to 90% of all side bet wagers may be used to contribute the jackpot, with underlying odds on the WEDGE event payouts adjusted.

Greater or lesser volatility and house advantage can be easily provided

General Considerations for Side Bet for Blackjack with Progressive Component

Side Bet should be made before cards are dealt in normal blackjack fashion.

Side Bet may be in any amount up to Ante or maximum values.

The side bet may be based on first three visible playing cards of player and dealer.

There are other controls over game play that can impact the house advantage and play. For example, the player may lose the side bet with a natural hard 17 (as no card can be between the 10-value card and the 7 without busting) and pushes or loses with a natural 18, 19 or 20 and loses, pushes or wins 1:1 with a blackjack.

It is to be noted that the odds for the various spreads are merely exemplary. In fact, odds at variance with apparent normal odds may be used. For example, the 10:1 odds appear to be typical odds for an event with a 1/13 probability. However, as the condition for the wager may not occur (the initial hand may be "dead" by being a pair, consecutive cards, face cards, etc. so the split side bet event may not occur), so that actual offered odds may be higher than even the statistical probabilities. For example, for a spread of one, odds of 13:1, 14:1; 15:1 or even higher may be offered. For a spread of two (with statistical odds of 1/6.5), odds of 6:1, 7:1 or even 8:1 or higher may be offered. In this manner, the casino may offer payout odds that are statistically higher than the probability of the spread being filled by a third card.

As can be seen, the player always also loses the underlying wager in blackjack when the player MUST take a hit to provide the third random card, with a natural 16 on the first two cards, as no card can be between 6 and 10 without busting. A same value card as either of the original cards is a loss. It is also possible to allow players to take a hit "off the books" for the blackjack event or baccarat event, such that the player may exercise a step in the side bet, without altering normal play in the blackjack game. This is the advantage of using electronic gaming or the dealer up card as the third playing card. It would also be desirable on electronic systems, or electronic gaming tables or electronic gaming machines (especially where there are multiple players) to have the spread identified, before, during or after provision of the wedge card, as this would be informative to the player(s).

A method of performing a side bet wagering event during a playing card wagering event on the gaming system described herein can be performed in which playing cards are exposed after being provided during play of the playing card wagering event including:

a) the player position providing a side bet wager against a paytable and a jackpot to be determined by playing cards provided to a card-receiving position at least one of a dealer hand position and the player hand position;

b) providing random physical playing cards to at least the dealer hand position and/or to the player hand position; and c) the processor making a random determination as to whether lights at the card-receiving position are to be lit or not lit.

The multiple random physical playing cards may be dealt to multiple card-receiving positions on the game play surface of the gaming system, and the processor makes a random determination as to whether lights at each of the multiple the card-receiving positions are to be lit or not lit; and causing lights to be lit or unlit at each of the multiple the card-receiving positions according to the random determination. The method may also resolve the side bet wager against the paytable or jackpot (including a progressive jackpot based at least in part upon how many lights at the multiple card-receiving position are lit or not lit. At least two or at least three random physical playing cards are dealt to at least two or at least three card-receiving positions and the random number generator communicates random number selections to the processor, the random number selections being individually indicative of whether or not lights at each of the multiple card-receiving positions; and lights being lit or being unlit depending upon communication from the processor to individual light controls for lights at each of the multiple card-receiving positions. Alternatively, the random number generator communicates a single random number selection to the processor, the single random number selection being indicative of a single template indicating whether or not lights at each of the multiple card-receiving positions are to be lit or not lit; and lights being lit or being unlit depending upon communication from the processor to individual light controls for lights at each of the multiple card-receiving positions based upon the single template. The method may be practiced wherein exactly four random physical playing cards are dealt (e.g., in baccarat) to exactly four card-receiving positions and the random number generator communicates a single random number selection to the processor, the single random number selection being indicative of a single template indicating whether or not lights at each of the exactly four multiple card-receiving positions are to be lit or not lit; and lights being lit or being unlit depending upon communication from the processor to individual light controls for lights at each of the exactly four multiple card-receiving positions based upon the single template. The templates would cover all ranges of events in individual or collective lighting of card-receiving positions, from zero positions lit to all positions (22-24 positions with seven players, one dealer and three initial player position cards and three initial dealer playing cards, with 1 or 3 cards exposed for the dealer/banker; or only 4-6 cards in baccarat, with two initial cards and a maximum of one additional hit card position). The available templates must therefore include (weighted or unweighted) a large number of possibilities, with every variation of lighting of individual card-receiving locations, which is approximately 24! (twenty-four factorial) individual events (approximately more than 100 billion probabilities, and this without weighting of individual events (e.g., weighting provides a larger number of outcomes that may be randomly selected than is physically or numerically possible, such as in choosing between 1 and 10, then gives disproportionate numbers of chances to each selection, such as providing 100 selectable outcomes for ten events, with 20 selectable events for 1, 15 selectable events for 2, and as few as one selectable event for 10, thus probability weighting each outcome). The system may be used for any dealing event, with any number of playing cards, but one preferred modality is when exactly and only three random physical playing cards (e.g., the three up cards in blackjack, three card poker, the three communal cards (the flop) first dealt in Texas Hold'Em) to determine an outcome in the progressive jackpot side bet and the method is performed on the gaming table and the side bet wager is provided through an electronic wagering input device at the player position on the gaming table to the processor, and the input device communicates location of a player position at which a side bet wager has been placed and an amount of the side bet wager to the processor. The processor may transfer a portion of at least 10% and less than 60% of the side bet wager into a progressive jackpot account monitored by the processor and the processor causes a display to visually indicate an available balance in the progressive jackpot. The jackpot may be a progressive jackpot and a highest payout from the progressive jackpot comprises a third physical random playing card being a suited rank card within a spread created by two of the same-suited playing cards that provide a spread of one at a hand position at which a side bet wager has been placed and the card-receiving position for each of the multiple random physical playing cards is lit by lights at the card-receiving positions.

These cards are scored using the traditional Baccarat scoring method, with the numerical value of all cards in a hand summed (with 10, Jack, Queen and King being zero value) and only the last digit (the unitary value digit) being considered.

The method is best performed where discards are required so that a highest count of 6, 7, 8 or 9 is formed in the two starting hand cards if possible and a lowest count among 0, 1, 2, 3, 4 and 5 is formed in the two starting hand cards. Variations in the best performance requirements may be that a highest count of 5, 6, 7, 8 or 9 is formed in the two starting hand cards if possible and a lowest count among 0, 1, 2, 3 and 4 is formed in the two starting hand cards. The method is preferably performed where playing cards are provided by provision of random physical playing cards provided from a randomized source of physical playing cards, and the physical playing cards are placed one-at-a-time from the source of physical playing cards to respective player hand position and banker hand position.

The method may be performed on a gaming table and the side bet wager are provided through an electronic wagering input device on the gaming table, and the input device communicates location of a player position at which a side bet wager has been placed and an amount of the side bet wager to a processor. The processor may transfer a portion of the side bet wager into a progressive jackpot account monitored by the processor and the processor causes a display to visually indicate an available balance in the jackpot. The method may designate a highest rank formed with only the four cards from a combination of the two random playing cards in the banker position hand and the two random playing cards in the player position hand is a pair or three-of-a-kind no winning outcome is present on the paytable. The method may be executed wherein when a highest rank formed with only the four cards from a combination of the two random playing cards in the banker position hand and the two random playing cards in the player position hand is a pair or three-of-a-kind no winning outcome is present on the paytable, or when a highest rank formed with only the four cards from a combination of the two random playing cards in the banker position hand and the two random playing cards in the player position hand is a pair or three-of-a-kind no winning outcome is present on the paytable, or when a highest rank formed with only the four cards from a combination of the two random playing cards in the banker position hand and the two random playing cards in the player position hand is a straight, no winning outcome is present on the paytable, or when a highest rank formed with only the four cards from a combination of the two random playing cards in the banker position hand and the two random playing cards in the player position hand is a flush, no winning outcome is present on the paytable. Various low frequency combinations of playing cards may be used as the four-card poker ranks to determine maximum payouts from the progressive jackpot. For example, a maximum payout from the progressive may be selected from the group consisting of four-of-a-kind and a same-suited A-K-Q-J. The method may be formed with other defined hand conditions to increase or reduce the frequency of the ranks that provide the maximum payout from the progressive jackpot. For example, the highest payout rank may be selected from the group consisting of a same-suited four-of-a-kind and a same-suited A-K-Q-J wherein the A-K are in a single one of the player position hand or the banker position hand.

As further described and enabled herein, the method may be performed wherein multiple players have placed side bet wagers against the paytable, at least some of the players being at player positions at a gaming table and at least some of the players being in electronic communication with the gaming table through the processor. A game performance issue occurs with this type of cross-technology and large number of players situations. As all side bet wagers rely on a single set of four cards (the first two banker position cards and the first two player position cards), the jackpot can be divided into so many small parts that the jackpot event becomes less attractive. For example, players would be attracted to a $1.00 side bet with a potential $50,000 or higher payout. However, if there are 100 players making side bets, an equal division of the jackpot would be only $500.00. Knowledgeable players would not be attracted to that side bet event because of the low return as compared to the probability of occurrence. A less desirable format is therefore where upon occurrence of a maximum payout event, the maximum payout is divided among all players having made the side bet. Numerous protocols can be implemented, especially with electronic wagering and a processor in the system. One simple adjustment is to limit the total number of players that can enter the side bet event (for example, in a first-come, first serve mode), or to apportion shares in the maximum payout based on amounts wagered on the side bet event (e.g., a $5.00 wager receiving five times the portion that a $1.00 wager would receive.

There are additional protocols wherein the processor is configured to execute a protocol that divides the maximum payout unequally among all players having made the side bet. The method could be configured such that the processor receives and stores electronic data from electronic wagering input devices comprising at least some data selected from the group consisting of a) length of time a player position has been wagering at the gaming table, b) number of consecutive hands that have been wagered on from a player position, c) average value of wagers made from a player position, d) maximum wager placed from one player position as compared to all player positions making side bet wagers, e) a random selection among players, and f) identified subsets of players based upon betting histories.

In baccarat, versus blackjack, similar procedures may be used. The banker hand or the player hand may be indicated (by wager or fixed rule, preferably as the spread defining hand. The two cards in that spread defining hand are dealt and the first card in the other hand is dealt face-up. The side bet (otherwise identical to the blackjack side bet) can be resolved at that point, before the second other hand card is dealt. An alternative variant, with lower hit frequency but accordingly higher payout odds may be used for baccarat. The two hands are referred to herein as the spread hand (in which the spread is determined) and the wedge hand, in which filling of the spread is determined. Two cards are dealt to each hand, and the split wager is resolved by at least one of the wedge hand cards being within the spread and the other of the cards being within the spread or equaling the rank of the (preferably lower rank) other card. The jackpot bonus may be won by the spread hand being a spread of one and the two spread hand cards being a predefined specific rank and suit combination (e.g., A of hearts and Queen of Hearts again, or A of Diamonds and 3 of Diamonds, again with a distribution/control of numbers of these cards that are specially marked. Special marking may be eliminated by requiring that both of the wedge hand cards fill the single rank spread with both wedge hand cards being the suited cards. For example, if the jackpot combination is A-K-Q of Hearts, the spread hand must have the A-Q of hearts, and both cards in the wedge hand must be the King of Hearts. A null card of a joker may also be present so that for the 100% jackpot to be won, the exact wedge card and the joker may be present. Smaller percentages can be won by the wedge hand having the exact filling rank and suit, and the other card being the same rank and the same color, but different suit, or just the same rank. In baccarat, specific order or collective content of specific cards may be used for the jackpot event. For example, the banker or player hand may be required to have the specific suited Ace and 4, the respective player or dealer hand must have the specific suited 2 and 3, and the two hit cards must be compatible with the requirements of the third card rule, the player's third card must be a same suited Ace or 2, and the banker hit must be the same suited 3. This may be done with or without specially marked Aces, 2's and 3's of the desired suit winning the jackpot level of the side bet. A paytable for other events, such as three-card ties, three zero-value cards in both hands, three zero-value same suited cards in individual hands or both hands, etc. These paying events are needed to keep the player engaged in the side bet game.

The wagering event may be practiced with at least one, two, four, six or preferably eight decks as the original set of physical playing cards and two physical playing cards are provided to each of the banker hand position and the player hand position to form a first residual set of physical playing cards having 412 physical playing cards and then any additional physical playing card provided to the player position will be provided from the first residual set of physical playing cards to form a second residual set of physical playing cards having 411 physical playing cards. Any additional physical playing card dealt to the banker position is provided from the second residual set of physical playing cards. As is typical with baccarat and blackjack gaming events, especially high-stake games, the original randomized set of playing cards is not played to exhaustion of the cards where card-counters could identify advantages or disadvantages in events, especially side bet events.

The method may use a set of any number of decks (e.g., 1, 2, 3, 4, 5, 6, 7, or 8 decks of virtual playing cards stored in memory in a processor which is configured to display virtual playing cards on a video display, and two virtual playing cards are provided to each of the banker hand position and the player hand position to form a first residual set of virtual playing cards in the memory having 412 physical playing cards (in an 8-deck set) and then any additional virtual playing card provided to the player position will be provided from the first residual set of virtual playing cards to form a second residual set of virtual playing cards having 411 virtual playing cards in memory. Any additional virtual playing card dealt to the banker position is provided from the second residual set of virtual playing cards. Gaming apparatus may comprise a processor, player input controls and a video display, wherein the processor is configured to execute the electronic virtual card method described herein.

Gaming apparatus comprising a gaming table having a randomized physical set of playing cards comprising 312 or 416 playing cards in a dealer shoe with only a back of one card displayed to live players, the gaming table configured to allow play of the physical playing card method described herein. Playing card shufflers or randomizers may be used in accordance with this method as further described herein.

Computer-Based Implementations—Methods of the present invention also may be implemented in computer hardware, software, or computer hardware and software. A most common form of computer implementation is a stand-alone, single player electronic gaming machine with electronic player controls and one or more video output screens. In computer-based embodiments, the gaming device preferably includes at least one processor, such as a microprocessor, a microcontroller-based platform, a suitable integrated circuit or one or more application-specific integrated circuits (ASIC's) or Field Programmable Gated Arrays (FPGA's). The processor is in communication with or operable to access or to exchange signals with at least one data storage or memory device, and/or a player monitor or monitors. In one embodiment, the processor and the memory device reside within the cabinet of a gaming device. Multiple gaming devices are typically connected to a casino information network.

The memory device stores program code and instructions, executable by the processor, to control the gaming device. The memory device also stores other data such as image data, event data, player input data, random or pseudo-random number generators, pay-table data or information, House Ways distributions and applicable game rules that relate to the play of the gaming device. In one embodiment, the memory device includes random access memory (RAM): which can include non-volatile RAM (NVRAM): magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device.

In other embodiments, part or all of the program code and/or operating data described above can be downloaded to the memory device through a suitable network. In one embodiment, an operator or a player can use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, for example part of a wireless gaming system. The gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "processor" or "computer" or "controller" or "game controller."

In one embodiment, the gaming device randomly generates awards and/or other game outcomes based on probability data. In one such embodiment, this random determination is provided through utilization of a random number generator (RNG), such as a true random number generator, a pseudo random number generator, a programmable RNG or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome. It is also possible for templates or weighted templates of sets of tiles or paylines as disclosed in U.S. Pat. Nos. 6,159,096 and 6,117,009 (Yoseloff, which are incorporated by reference in their entirety) which disclose a method of configuring a video output gaming device to randomly generate game outcomes. The method includes the steps of selecting a set of game symbols, assigning a probability of occurrence to each symbol, selecting a plurality of outcome templates, each template comprising X variables, selecting a probability of occurrence for each outcome template, assigning a subset of symbols from the set of game symbols to each template for filling the positions, defining payouts for selected outcomes, and configuring a video output gaming device, which randomly selects a template, randomly selects a symbol for each variable in the template from the subset of game symbols assigned to the selected template, randomly fills at least a portion of the positions in the template and displays the outcome on a video output display. A video output gaming device programmed to randomly select a template, randomly select symbols to define the variables and randomly display the selected symbols is also disclosed.

In one embodiment, described in more detail below as a "chipless gaming platform", the gaming device includes one or more display devices that are mounted into a gaming table surface and are controlled by the processor in addition to or separately from the individual player monitors. The display devices are preferably connected to or mounted into the table structure. This may include a central display device which displays a primary game, dealer images, jackpot information, or information that is not specifically related to the game, such as sports information or winning events at other tables. This display device may also display any suitable secondary game associated with the primary game as well as information relating to the primary or secondary game (e.g., side bets, bonuses, jackpots and the like).

An alternative embodiment may include a central horizontal game display device and a vertically oriented virtual dealer display device as in Shuffle Master, Inc.'s Table Master™ gaming system. The central display device may display the primary game, any suitable secondary game associated or not associated with the primary game and/or information relating to the primary or secondary game. These display devices may also serve as digital glass operable to advertise games or other aspects of the gaming establishment. The gaming device includes a credit display 20 which displays a player's current number of credits, cash, account balance, or the equivalent. In one embodiment, the gaming device includes a bet display displays a player's amount wagered. In one embodiment, as described in more detail below, the gaming device includes a player tracking display which displays information regarding a player's play tracking status.

In yet another embodiment, at least one display device may be a mobile display device, such as a PDA or tablet PC that enables play of at least a portion of the primary or secondary game at a location remote from the gaming device. The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism.

In one embodiment, as described in more detail below, the display device includes a touch-screen with an associated touch-screen controller. The display devices may be of any suitable size and configuration, such as a square, a rectangle or an elongated rectangle. The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, images of dealers and the like. Other forms of the invention are in the form of game software that is implemented in a variety of formats, such as internet gaming, PC practice play, hand-held game devices, wireless gaming devices and the like.

Chipless Gaming Table Implementation—One enabling system useful in the practice of the present invention is the use of playing cards with Chinese domino symbols which can be distributed for use with a system marketed under the name i-TABLE™ by Shuffle Master, Inc. of Las Vegas, Nev. That system includes: a) a physical gaming table; b) player monitors at each player position; c) a playing card reading and delivery system (e.g., commercially available shufflers and playing card delivery shoes with reading capability as sold under the Trade names of One2Six™ shuffler, Ace™ shuffler, I-DEAL™ shuffler, I-SHOE™ delivery shoe, etc.); d) a processor receiving information (numbers of cards, rank of cards, suits of cards, etc.) from the card reading and delivery systems; e) communication connectivity (hard-wired or wireless) between necessary combinations of the card reading/delivery systems and the processor, the processor and the individual player monitors, and/or the card reading/delivery systems and the video monitors; and f) software in the processor that defines predetermined advantage for distributions of playing cards into multiple hands, game rules, hand history, and the like.

A preferable card handling device for administering a video reel-type-style game is a hand-forming shuffler with integrated card recognition technology, from which playing cards are supplied, with a least a rank/count (and preferable also suit) of individual packs of cards are known before the cards are removed and delivered to player positions and/or the banker position. The card delivery system 102 is in communication with the controller 128 by wired or wireless communication methods. Communication between the various system components is not limited to electronic or electrical signals, but may include optical signals, audio signals, magnetic transmission or the like.

The shuffling devices work with various physical platforms. The shufflers may create a fully randomized set of cards that are removed one-at-a-time. Other shufflers separate cards into different compartments and then randomly deliver cards from the compartments. Other shufflers order the playing cards in compartments and then randomly select playing cards. Other randomization equipment (which do not actually shuffle cards) takes a set of playing cards are randomly ejects or randomly selects and removes playing cards from a set of playing cards. The individual player position processors (not shown) are preferable graphics processors and not full content CPUs as a cost saving, space saving, and efficiency benefit. With the reduced capacity in the processor as compared to a CPU, there is actually reduced likelihood of tampering and fraudulent input.

Game history information regarding previous games played such as an amount wagered, the outcome of the game and so forth may also be stored in a non-volatile memory device. The information stored in the non-volatile memory may be detailed enough to reconstruct a portion of the graphical presentation that was previously presented on the gaming machine and the state of the gaming machine (e.g., credits) at the time the game of chance was played. The game history information may be utilized in the event of a dispute. For example, a player may decide that in a previous game of chance that they did not receive credit for an award that they believed they won. The game history information may be used to reconstruct the state of the gaming machine prior, during and/or after the disputed game to demonstrate whether the player was correct or not in their assertion. Another feature of gaming machines, such as gaming computers, is that they often contain unique interfaces, including serial interfaces, to connect to specific subsystems internal and external to the slot machine. The serial devices may have electrical interface requirements that differ from the "standard" EIA 232 serial interfaces provided by general-purpose computers. These interfaces may include EIA 485, EIA 422, Fiber Optic Serial, optically coupled serial interfaces, current loop style serial interfaces, etc. In addition, to conserve serial interfaces internally in the slot machine, serial devices may be connected in a shared, daisy-chain fashion where multiple peripheral devices are connected to a single serial channel. The serial interfaces may be used to transmit information using communication protocols that are unique to the gaming industry. For example, the Netplex™ system of IGT is a proprietary communication protocol used for serial communication between gaming devices. As another example, SAS is a communication protocol used to transmit information, such as metering information, from a gaming machine to a remote device. Often SAS is used in conjunction with a player tracking system.

Gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this. Trusted memory devices are preferably included in a gaming machine or gaming table computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc.

During the course of a game, a player may be required to make a number of decisions, which affect the outcome of the game. For example, a player may vary his or her wager on a particular game, select a prize for a particular game selected from a prize server, or make game decisions which affect the outcome of a particular game. The player may make these choices using the player-input switches, the video display screen 34 or using some other device which enables a player to input information into the gaming machine. In some embodiments, the player may be able to access various game services such as concierge services and entertainment content services using the video display screen 34 and one more input devices.

During certain game events, the gaming machine or table may display visual and auditory effects that can be perceived by the player. These effects add to the excitement of a game, which makes a player more likely to continue playing. Auditory effects include various sounds that are projected by speakers. Visual effects include flashing lights, strobing lights or other patterns displayed from lights on the gaming machine or from lights within the separate mechanical (or electronic) separately, individually wagerable gaming system. After the player has completed a game, the player may receive game tokens from the coin tray or the ticket from a printer, which may be used for further games or to redeem a prize. Further, the player may receive a ticket 20 for food, merchandise, or games from the printer. When acting under the control of appropriate software or firmware, in some implementations of the invention a CPU may be responsible for implementing specific functions associated with the functions of a desired network device. According to some embodiments, the CPU accomplishes all these functions under the control of software including an operating system and any appropriate applications software. The CPU may include one or more processors. In an alternative embodiment, processor is specially designed hardware for controlling the operations of any network device. In a specific embodiment, a memory (such as non-volatile RAM and/or ROM and especially a random number generator component or software) also forms part of the CPU. However, there are many different ways in which memory could be coupled to the system. A memory block may be used for a variety of purposes such as, for example, caching and/or storing data, programming instructions, etc.

There are many available variations and standard situations that can be addressed in the execution of the present direct game or side bet event in the present technology. The following discussion will attempt to address those variations, which may be mixed or excluded to implement a side bet wagering event with either blackjack or baccarat.

Aces are generally considered 1-value cards in baccarat. The unique event in baccarat can therefore be either a same-suited Ace-3, or a same-suited Ace-Queen for the 100% payout. Both of those point counts would ordinarily require an additional card, so game play would not be altered in either selection of the unique 100% jackpot event (or 5%, 10%, 20%, 25% etc. jackpot events). Pairs are automatic losses on the side bet for baccarat. In blackjack, players may elect to split pairs, but to engage the side bet event, an additional (preferably equal or less) side bet wager must be placed on a second hand for the second hand to be in play. Otherwise, only the first hand (player's furthest right set of cards).

Ace ranks in blackjack can be more complicated, but can be easily regulated. For example, aces should usually be maintained as an 11-value card for the side bet event. For purposes of the jackpot unique events, however, the rank may be considered as a 1-value card for the Ace-3 combination in first two cards, and may be considered as a 1-value card in combination with a 3 (unsuited), any 4, any 5, (possibly) any 6 (treating the combination as a soft 17), but should be considered an 11-value card with any 7, 8, 9 or 10-value card (not sacrificing a blackjack for the side bet). House procedures may vary this, but the above is recommended.

The occurrence of certain events (with respect to the side bet) has already been addressed, but there are acceptable variations among them. By way of non-limiting examples, so as to minimize a feeling of "unfair" results with the side bet wager, certain natural hands can be specifically addressed. A hard 17 with a 10-value card (as opposed to an 8-9 combination) may be considered a push or a loss. A hard 18 with a 10-value card (as opposed to a 9-9 combination) may be considered a push or a loss. All hard 19's (with a 10-value card) may be considered a loss or a push. All hard 20's (with two 10-value cards) may be considered a loss or a push. All 10-value cards may be considered as a single rank (a rank between 9 and Ace), so that with an initial two cards of 9 and King, the third card of a Jack would not be an intermediate card, nor would a Queen or 10. This may be varied, with the 10 itself being considered as distinct from the Jack, Queen or King in determining intermediate ranks within the spread. All pairs can be considered in the first two cards as losses, unless the player elects to split them and place a second side bet wager for the second hand. If the pairs are aces, however, the side bet is lost as most casino blackjack events allow only a single hit at each hand position when aces are split. This consideration of events complies with standard blackjack practice to minimize alteration of game play.

Players may elect to "convert" an Ace in combination with a ten value card to a 1-value Ace. To do so, the player may be required to double the amount of the side bet, and in that circumstance, it is likely that all 10-value cards would be equal. The "conversion" would also have to be permanent, such that the blackjack is lost. The player may (as with a double down) be allowed only a single hit if this is done, or may be allowed only two hits. The method may require that the resolution of the side bet as a winning event outcome occurs only when the spread is at least two and both of the third and fourth fill the spread. The different percentages of the jackpot that may be awarded should be restricted to when at least one of the cards determining the spread (of exactly two card ranks) or at least one of the third and fourth cards (exactly filling the two card ranks in the spread) have a jackpot bonus marking on them.

Any side bet and any underlying game technology may be used in combination with the gaming system described herein. The control of the special symbols in the electronic format may be adjusted and controlled to provide other elements into the outcome determinations. For example, rather than providing a simulated 8 decks with exactly 6 or 9 of the specific ranked cards (e.g., A, K and Q) virtually marked, the specially marked symbols may be randomly assigned to virtual cards, such that (using an 8-deck set as an example, with 416 virtual cards), the random symbols may be provided to any displayed card at a frequency of 6/416 times or 9/416 times. When all three of any cards, in any order or arrangement have the three special symbols, a bonus payment on the side bet of at least $50.00 may be paid. At least $2.00 may be paid for any single specially marked cards. When two such random specially marked cards appear, a special bonus of at least $20.00 may be paid. This again increases the rate of frequency of winning events and increases the volatility of the wager.

All pairs and adjacent card ranks (e.g., 2-3, 5-6, 9-10, 9-K [as 10-King are equal], and all Blackjacks are dead hands for the side bet as there is no SPREAD.

In Baccarat, the same principle exists. If the wager is made on the Banker Hand (there is no commission or possible difference in frequency between the Player and Banker hands in this wager), the best format is to require that BOTH Player hand cards fall within the SPREAD created by the Banker hand cards. There is flexibility in the event outcomes so that even higher odds can be paid on non-jackpot events. It is possible to have the wager allow for only one of the two opposing hand cards to Wedge within the SPREAD, but this leads to much lower payout odds, e.g., no more than 2:1, 3:1 or 4:1 on any event.

Odds for a 2-Card SPREAD win (e.g., Banker Hand having an Ace and 4, and the player hand having a 2 and 3) can be 50:1 or higher. Even a 2-10 initial hand can pay 2:1 or 3:1 for a two card Wedge result. This volatility and high odds are very attractive.

Your Mix-and-Match games can fit into these. An important security aspect, however, in your 3-Card Blackjack is that the first two cards must be positioned in a 1st END position and a 2nd END position to define the SPREAD. This is because the player cannot be allowed to create the SPREAD himself. It destroys the odds.

A 4-Card Baccarat works much better, as the single card is used as the WEDGE card against the SPREAD created by the opposed 2-card hand. The side bet would be played exactly the same as the Blackjack version.

This invention enables achievement of a previously is the technically difficult outcome, developing a large progressive jackpot resolved before play of a game, with only 3 or 4 playing cards exposed. Probabilities in 3-Card events (two player cards and 1 dealer up-card or three cards in a player hand), which is why Three-Card Poker® games have a maximum of 40-1 payout. Even with a positional requirement and same-suited requirement (e.g., A-Q of spades in player hand and King of Spades as the dealer up-card), the frequency is still about 1/10,000, so the jackpot would average about $10,000 without seeding). In the 2-card Wedge for baccarat, the frequency is still about 1/75,000 which does not achieve the industry targeted jackpot levels of at least one million.

Control Variables with Single Suit Only in Progressive Win

There are many event outcome controls that can be used to adjust the House Advantage.

In Blackjack, it is desirable to have 10-J-Q-K of equal 10-value. They may be used in poker style ranks where 10<J<Q<K, but then the odds on the other payouts will accordingly be lowered, in some cases significantly. All blackjacks are therefore considered adjacent cards and although the player wins the blackjack, the side bet is over. This will also allow the tables to continue paying 3:2 on blackjacks, while many are shifting to 6:5. The odds may be varied significantly, with payout odds on a single card SPREAD (e.g., 2-4) allowable between 8:1 and 15:1, while still offering a house advantage of 17% to 8.5%, respectively along with other changes in odds. Suits do not necessarily matter in the wedge outcomes for the side bet, except for the single (may have multiple, but that complicates marking and reading etc.) specific spread and wedge for the jackpot.

In Baccarat, the 10-J-Q-K are equal zero-value cards, keeping the reading of the cards the same. Therefore, again, A-K, A-Q, A-J, A-10 and A-2 combinations are "dead" hands for the side bet. It is preferred to require a 2-rank SPREAD as a minimum (e.g., 2-5) rather than allowing a 1-rank SPREAD minimum (e.g., 2-4), but both may be used, with the 1-rank SPREAD requiring a pair for a winning outcome.

The use of the same three marked cards (e.g., some but less than all of the A-K-Q or A-2-3) in the four-card Progressive Jackpot hand keeps the frequency in the 4 million or 20 million to 1 range. By changing it to four specially marked bonus cards for 100% payout, the frequency can exceed 100 million to 1, which is too infrequent. However, the payout odds could be adjusted to

| | |
|---|---|
| A-K-Q-J with four specially marked cards | 100% of the Progressive jackpot |
| A-K-Q-J with three specially marked cards | 30% of the Progressive jackpot |
| A-K-Q-J with two specially marked cards | 15% of the Progressive jackpot |
| A-K-Q-J with one specially marked card | 5-10% of the Progressive jackpot |

This will keep the frequency of Jackpot payouts high enough to show significant bonus activity in the game. The odds on the non-Jackpot side bet events can also be adjusted. The use of only three indicators can limit numbers of payouts from the jackpot, with decreased frequency. The use of more than four (e.g., up to 100) indicators will increase the number of payouts with smaller amounts at increased frequencies. Again, without a continuous shuffler or electronic random number generation, an electronic panel or manual markers showing remaining critical cards should be used.

The partial exhaustion of critical cards will not have as critical an impact on the desirability of the Progressive wager for a number of reasons. There are still attractive partial jackpot events with fewer specially marked cards, and as long as there are specially marked bonus cards, exhaustion of other cards against shifts the richness or probability of the remaining specially marked bonus cards higher.

Simplified Variable Gaming Table Structure

Figure 5:
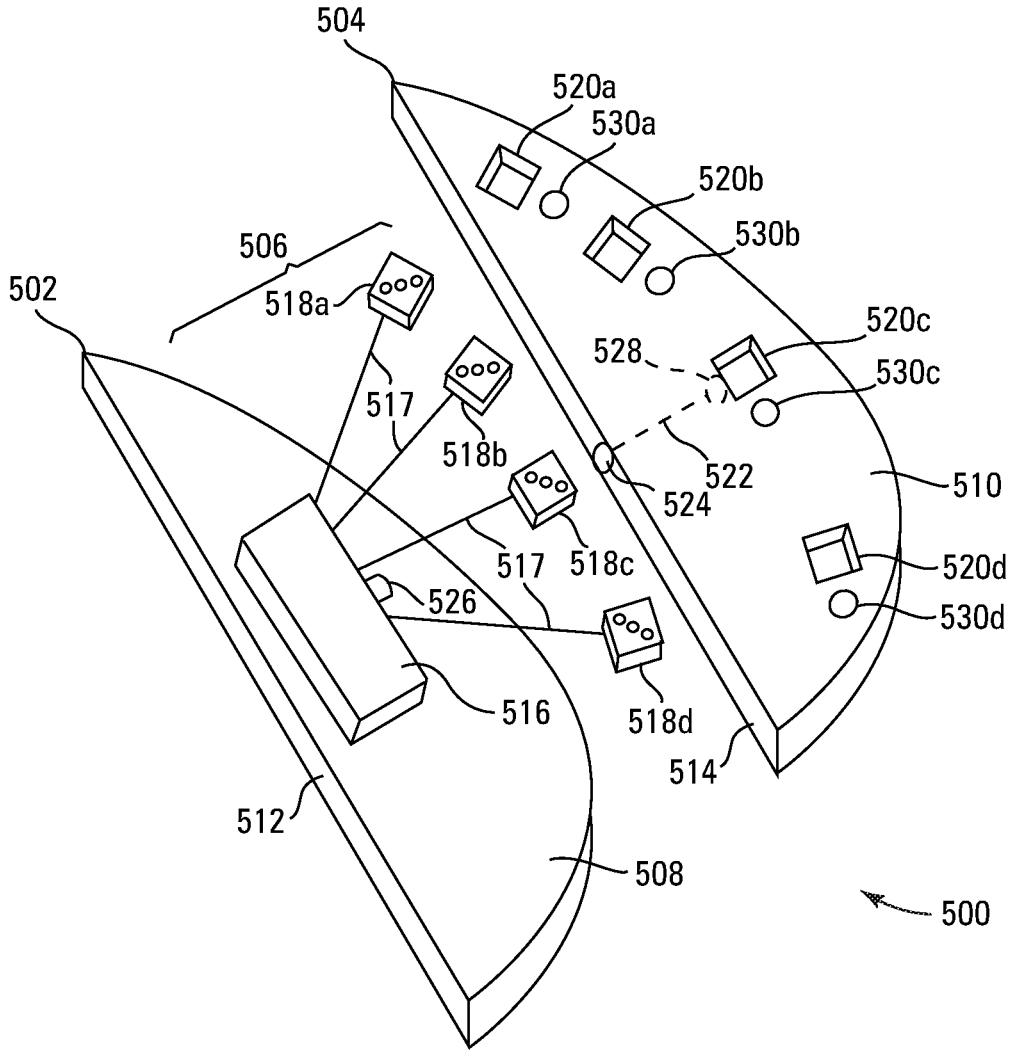
FIG. 5 shows a perspective exploded view of a gaming table including a four-channel secondary random event generator of the present technology.

It is often important in industry to provide a more versatile system that is highly flexible, easily configured to multiple uses, and simple to construct. This engineering principle is emphasized in FIG. 5, which shows a perspective exploded view of a gaming table system 500 including a four-channel secondary random event generator 526 of the present technology. Again, four channels are shown to simplify the Figure, whereas 2-10 channels for example) may be provided on a table, and preferably 5-8 player channels and at most one dealer channel may be provided. The gaming table system 500 is shown with a base support layer 502 and a gaming table top cover layer 504. The base support layer 502 has an edge facing 512 that would face the dealer (not shown) and an upper support surface 508. The upper support surface 508 carries the secondary random number generator and any included circuitry 516 necessary for relaying the secondary random number generator events. The circuitry may be supported by a wireless output component or I/O connection port 526 as integrated or not into the system 500. The secondary random number generator and any included circuitry 516 is shown to be wired to four separate and distinct individual player position visual output devices 518*a*, 518*b*, 518*c* and 518*d* by individual dedicated wires 517 to form an insertable secondary random event generation component 506 which includes all elements of 516, 517, 518*a-d* and 526 (where used). Where there are fewer or more player positions, there would be fewer or more visual output devices such as 518*a-d* and possibly a dealer visual output device in communication with the secondary random number generator and any included circuitry 516.

The table top cover layer 504 is supported by a table structure (e.g., ridges on a table, not shown) and provides a gap between the surfaces 510 of the table top cover layer 504 and the base support layer 502 which has an edge facing 512 that would face the dealer (not shown) and an upper support surface 508. The gap or spacing allows placement of the (as shown) elevated secondary random number generator and any included circuitry 516 and its associated output component or I/O connection port 526 (if present), and the (as shown, but not limiting) four separate and distinct individual player position visual output devices 518*a*, 518*b*, 518*c* and 518*d* by individual dedicated wires 517 that form the insertable secondary random event generation component 506. The separate and distinct individual player position visual output devices 518*a*, 518*b*, 518*c* and 518*d* are respectively positioned so as to be exposed through holes or openings 520*a*, 520*b*, 520*c* and 520*d* in the table top cover layer 504. Each separate and individual player position is also shown with a side bet or jackpot bet sensing/entering input system as 530*a*, 530*b*, 530*c* and 530*d*, respectively. An alternative construction may include a wireless or wired communication port 524 in linked communication path 522 to an individual opening (520*c* is exemplified, but paths would be to each separate and distinct individual player position visual output devices 518*a*, 518*b*, 518*c* and 518*d* as by a further direct connecting port 528 to each separate and distinct individual player position visual output devices 518*a*, 518*b*, 518*c* and 518*d*. The communication links/wires 517 are shown in a parallel arrangement, but as each of the separate and distinct individual player position visual output devices 518*a*, 518*b*, 518*c* and 518*d* would have its own identity, the communication link could alternatively be serial or by wireless communication.

Additional Games

Double-Triple Poker™ Game

A single hand of 3 cards for poker is dealt. A first mandatory wager is for standard or slightly substandard Three-Card Poker® game play. Typically, the dealer must qualify with Q-high or better. The paytable on the first mandatory wager may pay the typical 40:1 Trips, 30:1 Straight Flush, 5:1 straight, 4:1 flush and 1:1 pairs, or be slightly lower for the highest hands such as 30-35:1 and 20-25:1. The top pay outs may be dropped to 35:1 and 25:1 or the like. An optional or mandatory second wager is also on the three-card Poker® game paytable, that may be a typically full payout (e.g., 40:1 and 30:1, top payouts), but the dealer may qualify with a Jack (or Jack-9) or higher, which strategically gives players a greater likelihood of being paid on good hands. The second wager must be at least the amount of the first wager, up to 2×, or 3×-5× the original Mandatory wager. A best 5-card poker hand out of the six cards (one player hand and one dealer hand) may also be played. The secondary random event generator could be used to alter paytables, allow a player hand to discard and replace one or more cards (e.g., only in the best 5 of 6 event) or allow a wild card(s) to be used, with random card(s) dealt from the residual cards after all cards have been dealt, the number of replacements or wild cards being dependent on results from the secondary random event generator (e.g., no cards dealt for a hand with no special random secondary event; one card with one special secondary random event; etc.)

Baccarat Side Bet—with 6 or 8 Decks

The best is placed and locked-in, then the secondary random light event is locked in.

| | |
|---|---|
| SUITED 9-TIE w/3-4-5-6 | 1000-5000:1 |
| SUITED 9-TIE SAME SUIT | 100-300:1 |
| SUITED 8-TIE SAME SUIT | 75-200:1 |
| SUITED 9-TIE DIFFERENT SUITS | 50-150:1 |
| SUITED 8-TIE DIFFERENT SUITS | 30-100:1 |
| 9-TIE | 20-30:1 |
| 8-TIE | 10-25:1 |
| Alternate Paytable | |
| SUITED 9-TIE w/3-4-5-6 | 1000 = −5000:1 |
| SUITED 9-TIE SAME SUIT | 100-500:1 |
| SUITED 8-TIE SAME SUIT | 75-400:1 |
| SUITED 9-TIE DIFFERENT SUITS | 75-150:1 |
| SUITED 8-TIE DIFFERENT SUITS | 50-125:1 |
| 9-TIE | 10-30:1 |
| 8-TIE | 10-25:1 |
| 7-TIE | 5-20:1 |

EXPLANATION OF TERMS—"Tie same suit" both hands have naturals with the same suit as the suits for their naturals) e.g. 2-7 spades and 1-8 spades. "Tie different suits" both hands have same suited naturals, but the suits for their naturals are different) e.g. 2-7 spades and 1-8 diamonds.

If my secondary random number generator is used with a side bet (1 unit through the minimum wager on the mandatory wager), some three card poker hand or 6-card poker hand combination with the dealer hand may be used to define a jackpot event. A 5-card straight flush (or Royal Flush to up the jackpot) with maximum lights (e.g., 4 lights) would be 100% of the progressive jackpot, 3 lights 15%, 2 Lights 5% and one light $500 (or 500 units). If the Royal Flush is 100%, the a 4-light straight Flush could get 5%. 4-of-a-kind would pay 50× the side bet wager, Full House 25×, Flush 4× and Straight 3×. While this invention is described in terms of preferred embodiments, there are alterations, permutations, and equivalents that fall within the scope of the invention. It should also be noted that there are many alternative ways of implementing the present invention. It is therefore intended that the invention not be limited to the preferred embodiments described herein, but instead that the invention should be interpreted as including all such alterations, permutations, and equivalents as fall within the true spirit and scope of the present invention.

This gaming table system may be networked with other game systems contributing to a progressive jackpot, preferably game systems having a probability of a winning outcome within ±10 percent of the probability of the present system, at least when the first random physical playing cards are delivered. Such systems could be purely electronic table games (no physical playing cards), electronic gaming machines (e.g., electronic blackjack on a networked video gaming machine), multiplayer platform banks of gaming elements, and on-line gaming. Such networking and more detailed descriptions of those separate venues are described in the related applications data section which references have been incorporated by reference, herein.

The gaming system may enable enhancement of wagering outcomes comprising: a) a gaming table having a game play surface; b) a first processor; c) a player input control at a player position, the player input control in communication with the first processor; and d) a random number generator in communication with the first processor; wherein the game play surface at the player position has light elements that are at the player position, and there is a power source in communication with the light elements; the first processor being configured, in response to random selections of light elements at the player position, to direct that light elements on the game play surface are randomly lit or unlit. There may again also be light elements in communication with the power source at a dealer card-receiving position and the first processor, in response to random selections of the light elements at the dealer position, is configured to that the light elements at the dealer position are lit.

The gaming system may have a second processor in communication with the gaming table provides a source of random virtual images on the gaming table for delivery of random symbols to the player position for use in a wagering event. These second processors may be at individual gaming tables or may be a central processor dedicated to one or more individual gaming formats as later described herein. In this manner, the light element enabled wagering event can be associated with a single gaming event or all gaming events within a venue. For example, individual playing card positions in card games can be "lit" randomly, individual symbol positions in video slot systems (e.g., 3×3, 3×5 and 5×5 displays) can be "lit" randomly, individual numbers in keno or bingo can be "lit" randomly, as well as random lights or dedicated lights independent of symbols, at player positions and/or at gaming tables. A random number generator can determine frequency of individual lights or composites of lights (e.g., by the template method described herein) that can be used to determine awards or jackpots. These awards may be independent of side bet wagers (e.g., they may act as random awards within a venue at any active player position, contingent upon a player at that position having an active, ongoing wager, for example, but without any special side bet) or may be dependent upon a side bet wager or a progressive jackpot side bet wager. The frequency and contribution, house hold and the like can be determined by the amount of awards for different events and the frequency set by the RNG (random number generator. For events where there is no wager contribution or even no additional wager (such as in a scatter award, where the occurrence of lights or multiple lights or color combinations of light elements lit at individual positions can determine the amount of awards), awards can be modest but attractive, such as $1.00, $5.00, $10.00, $25.00, $50.00, $100.00 and more. Where there are side bets required for participation in the light element-based awards, the amount of the awards and/or the frequency of the awards can be increased. Similarly in a progressive side bet event, the parameters exercised through the RNG can determine frequency and amounts of awards, and house advantages can be controlled easily. This unique system offers controls over payment that can be totally independent of wagering events or bet ties to wagering events and outcomes as with the special games discussed herein. The size of the awards can be tied to game events to again make the award sizes either larger, smaller, more frequent or less frequent, as desired. For example, with any blackjack and one lit player position light, the blackjack payout may be in a range from a 2× multiplier up to a portion of a progressive jackpot, and with two lights lit at the player position with a blackjack, the blackjack may be in a range of from a 5× multiplier up to a 100% progressive jackpot award.

The lights may be used with any bonus or jackpot game as described above, in place of specially marked cards, to produce higher average progressive jackpots. Again, however, by altering the frequency of the random lighting at player positions, frequency and size of winning outcomes can be controlled and adjusted at the designer's choice. For example, with an individual lit light frequency of 1/416, an eight deck shoe with a single set of three marked cards can be approximated. With a lit light frequency of 1/156, a six deck shoe with two sets of three marked cards can be approximated. With 1/78 lit light frequency, a six deck shoe with 4 sets of three marked cards is approximated. In poker, bingo, keno, roulette, craps and other table games, the frequency of lit lighting can be controlled by the first processor to balance frequency of hits and size of awards independent of underlying game wagering event outcomes or tying the size and frequency to the underlying wagering game event outcomes.

The gaming system may have a second processor in communication with the gaming table provides a source of random virtual images on the gaming table for delivery of random symbols to the dealer position for use in a wagering event. The gaming system may have a source of random virtual symbols is associated with a game processor providing a first set of symbols for use in a first wagering format selected from the group consisting of virtual playing card wagering events, column and row video virtual slot wagering events, virtual roulette wagering events, virtual keno wagering events, virtual dice wagering events, and virtual bingo wagering events. The system may also be provided on physical gaming table wagering events.

The gaming system may enable and be configured to provide a system with communication between the first processor and multiple different wagering events selected from the group consisting of virtual playing card wagering events, column and row video virtual slot wagering events, virtual roulette wagering events, virtual keno wagering events, and virtual bingo wagering events, virtual dice wagering events, and the first processor randomly selects lights to be lit at each of the gaming tables having the multiple different wagering events.

The gaming system may have each gaming table is configured to perform multiple ones of the multiple different wagering events from a single player input terminal at the each gaming table.

The gaming system may have each player position have a player input terminal having a dedicated input function for wagering an amount into a progressive jackpot and the first processor executes software to manage the progressive jackpot by accumulating at least portions of the amounts wagered into the progressive jackpot and awarding at least portions of the progressive jackpot based upon random lighting of lights at the player position and/or the dealer position.

A method of performing a wagering event during a wagering event on a gaming system as described herein could include:

a) the player position providing a wager that includes a wager against a paytable, outcomes of the wager against the paytable being determined at least in part by whether or not a first processor has randomly caused light elements at the player position to be lit;

b) the first processor making a random determination as to what specific images/numbers/colors/lights at the card-receiving position are to be displayed or the multiple random virtual symbols may be provided by a second processor to individual player positions at the game table and the light elements are associated with individual symbols as a distinct characterization of the random individual symbols used in determining wagering event outcomes.

Again, physical wagering event implements (physical playing cards, reel slots machines, keno boards, keno tickets, dice, roulette wheels, physical bingo sheets, etc.) may be used with the lighting being distally controlled, or individual cards, tickets, sheets, displayed on a view board where the random light element events are separately displayed.

Figure 3:
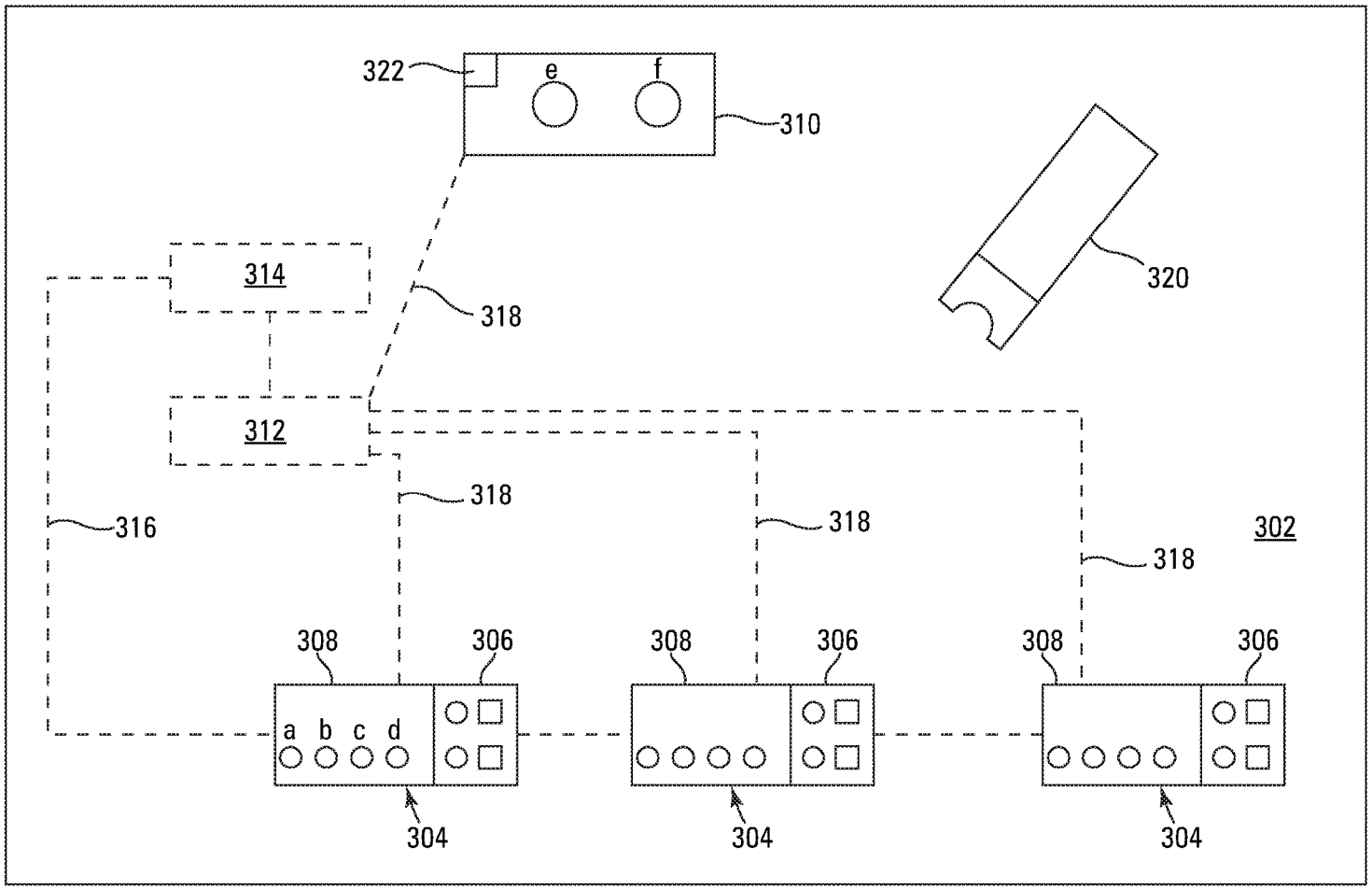
FIG. 3 shows a view of a gaming table useful in the practice of the present technology.
Figure 4:
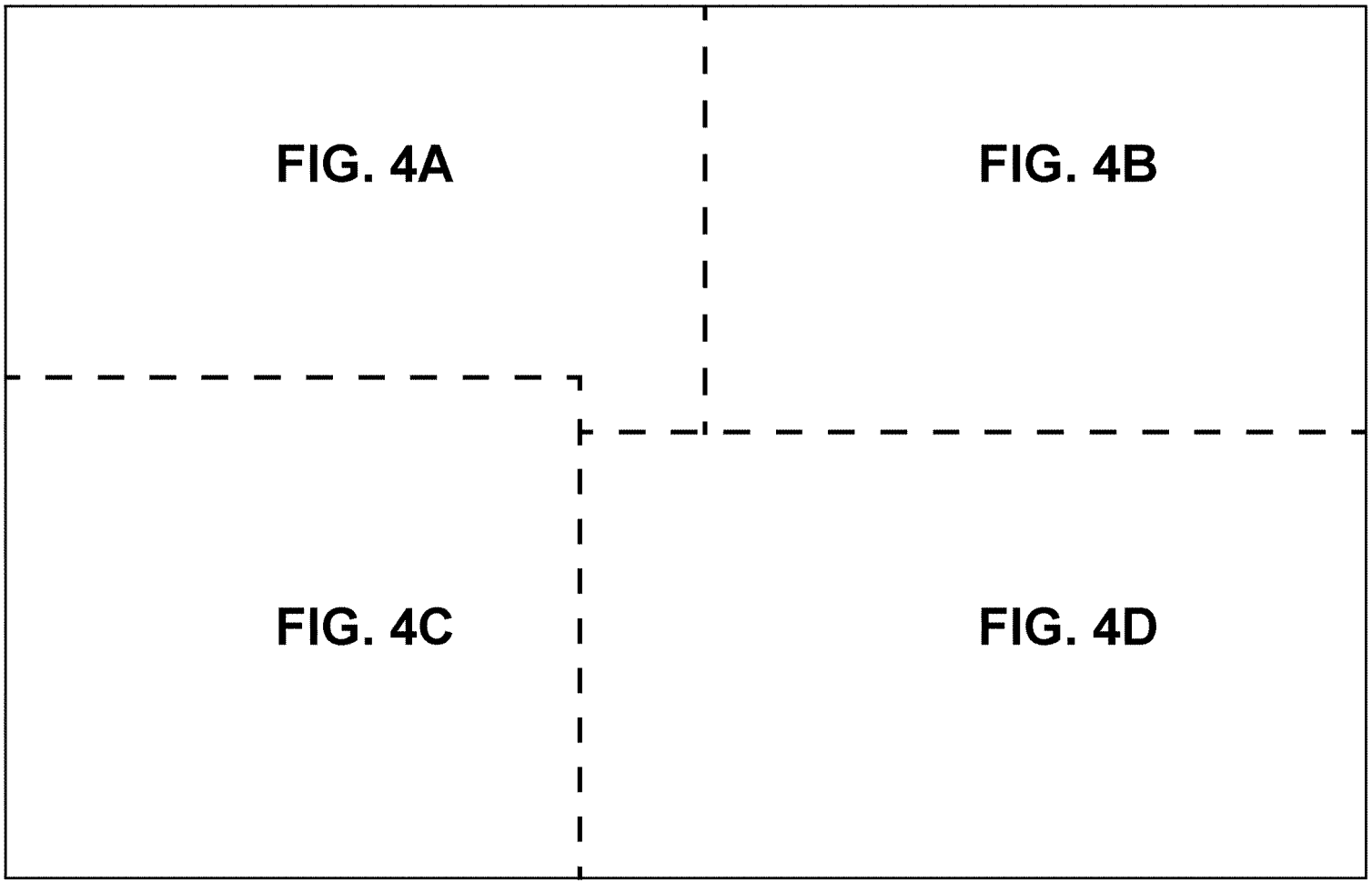
FIG. 4 shows a four-segment template of a schematic of a four channel secondary random event generator of the present technology having quadrant segments 4A, 4B, 4C and 4D.
Figure 4A:
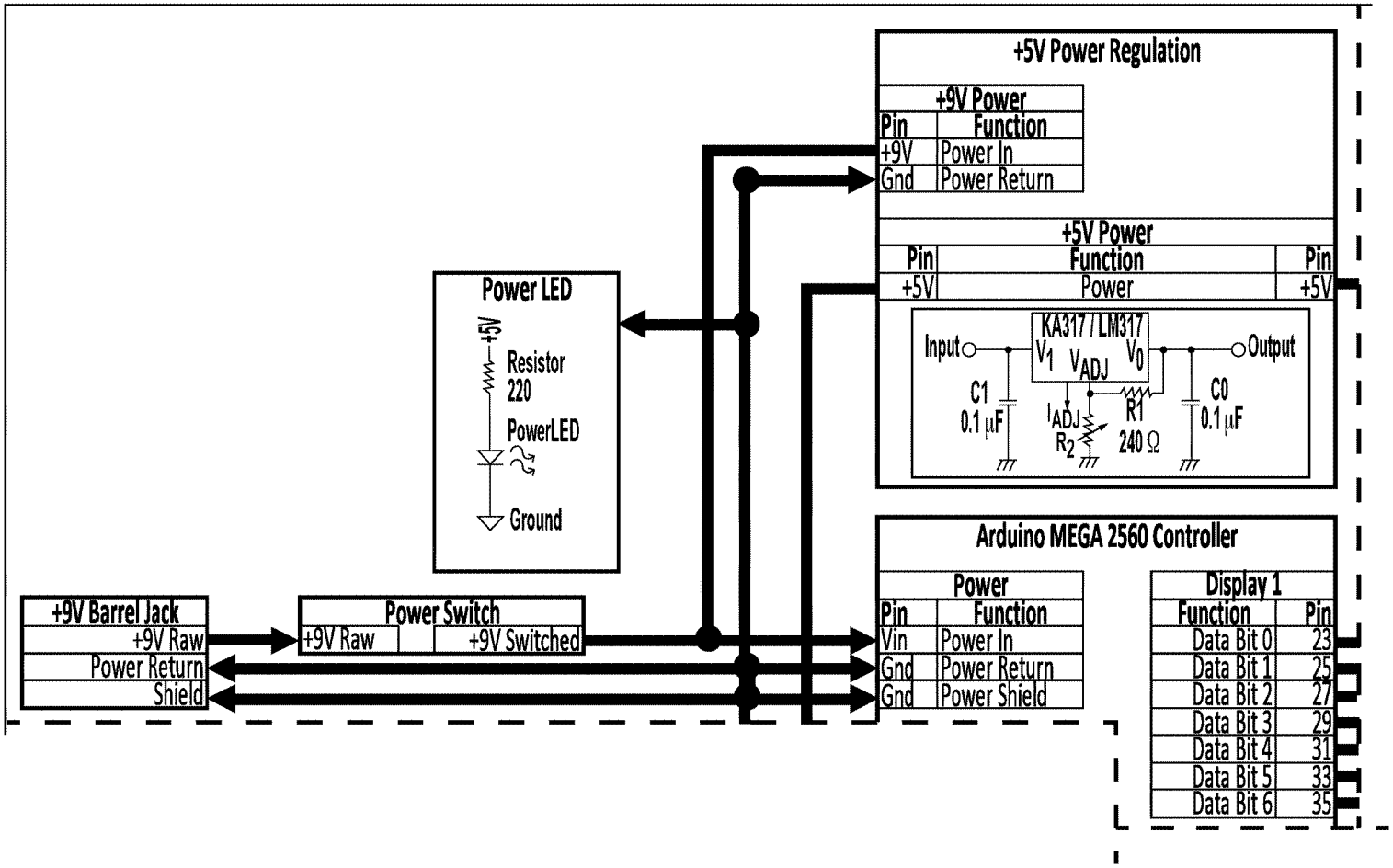
FIG. 4A shows quadrant 4A of the schematic of FIG. 4.
Figure 4C:
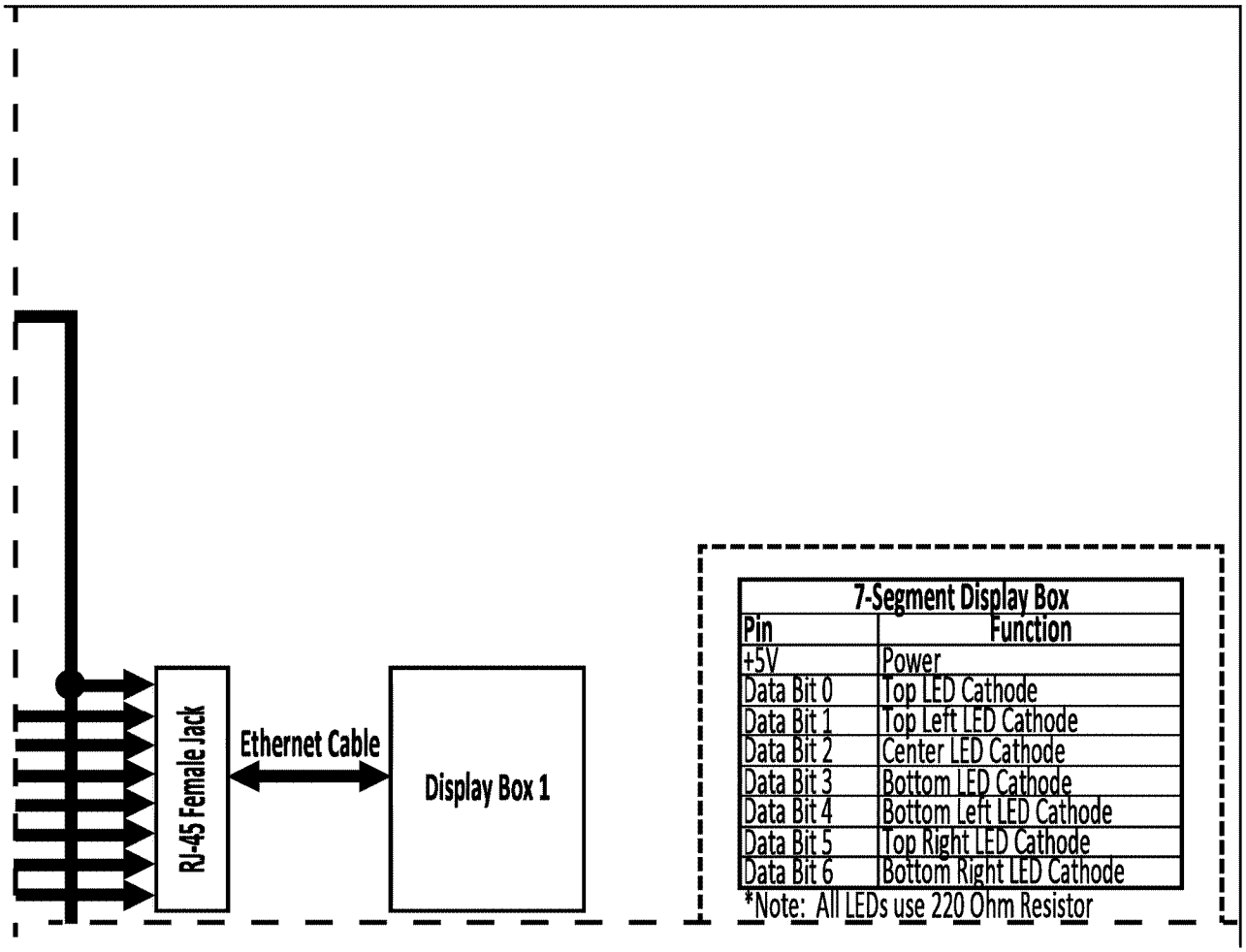
FIG. 4C shows quadrant 4C of the schematic of FIG. 4.
Figure 4C:
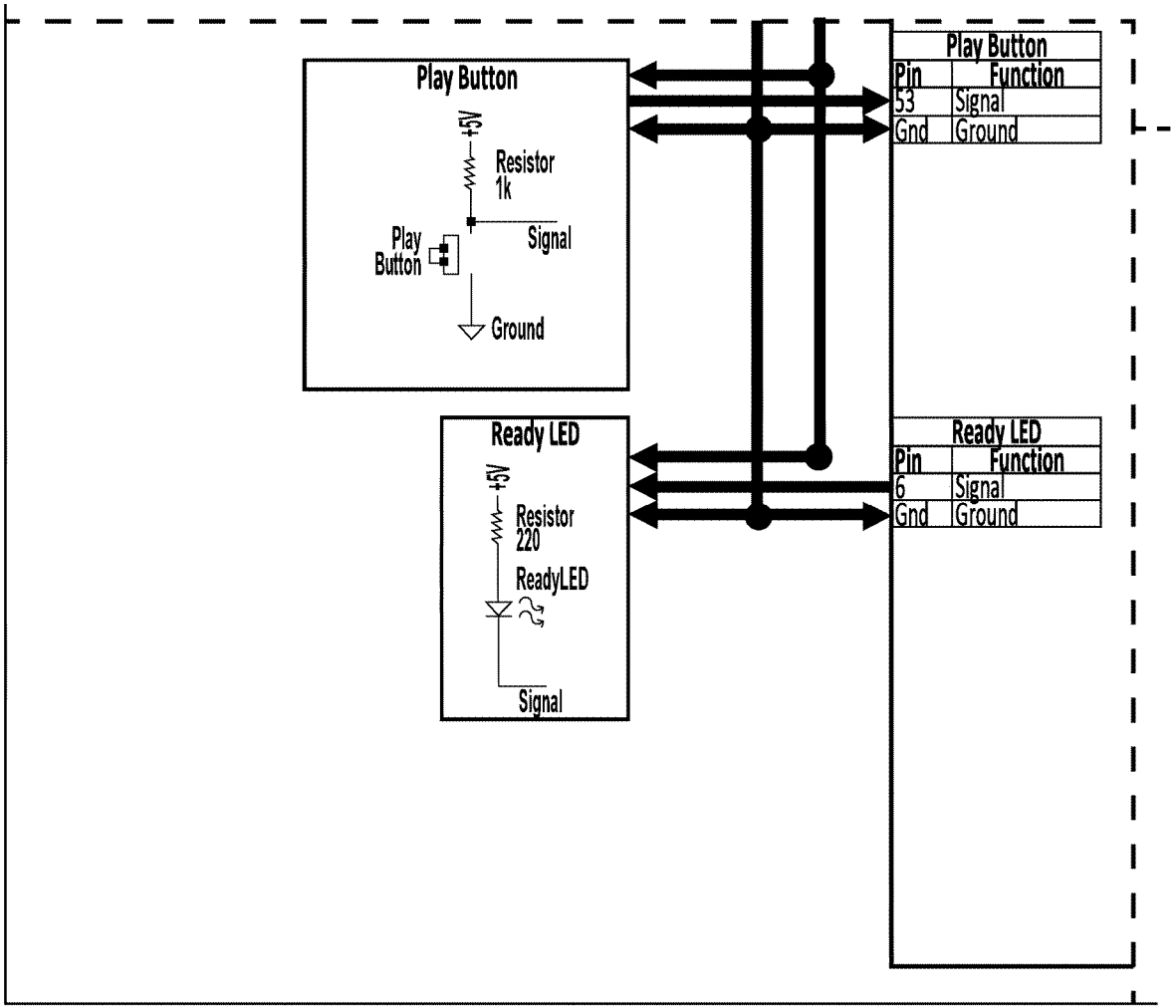
Figure 4D:
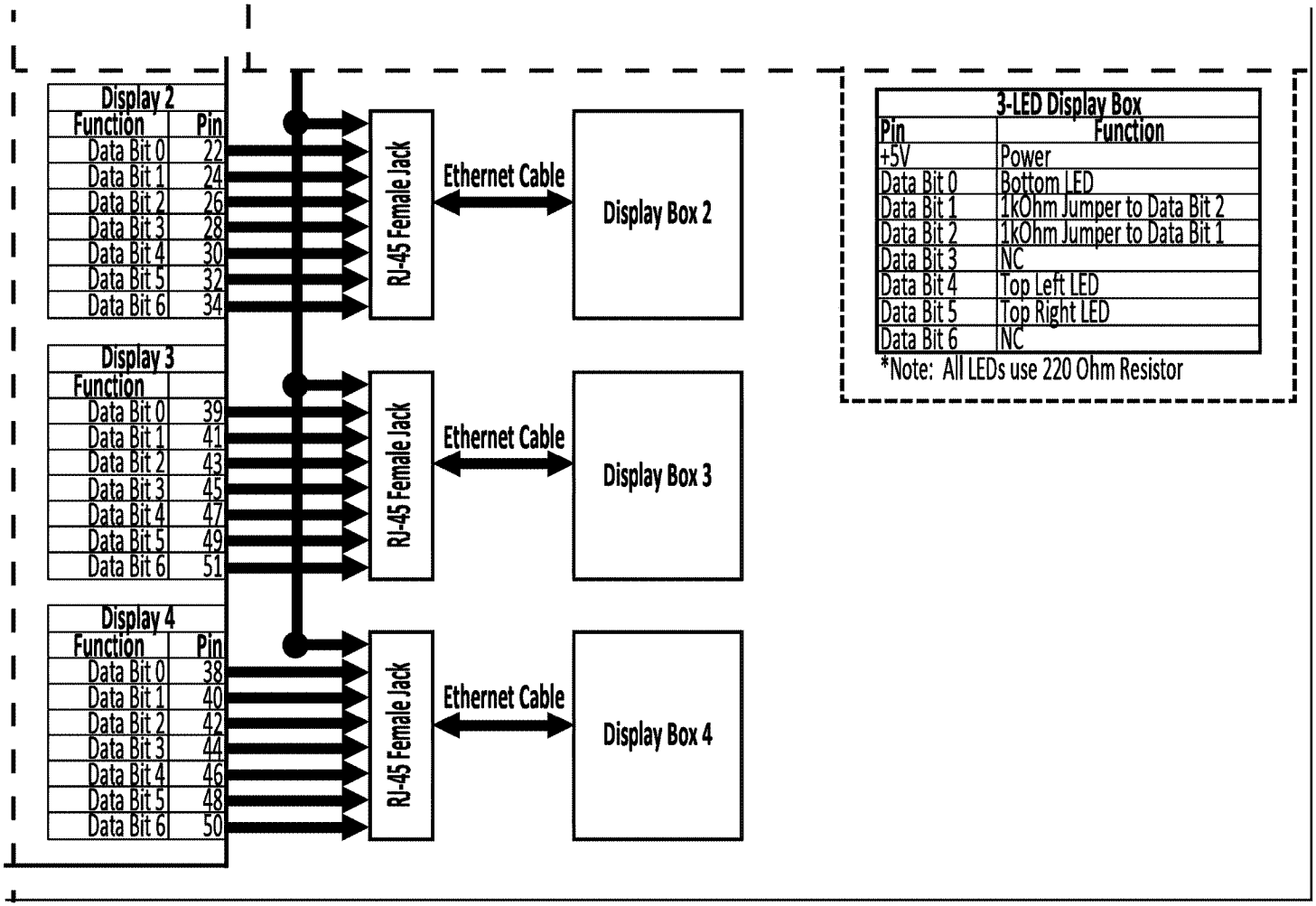
FIG. 4D shows quadrant 4D of the schematic of FIG. 4.

The gaming table technology described herein is extraordinarily flexible with respect to provision of gaming content and additional wager/outcome control to the gaming table itself. This can be added to any existing game and most gaming tables by retrofitting the gaming tables having electronic functionality, even as simple as just the electronic wagering input panels used with physical playing card games. FIG. 3 shows a view of a gaming table 300 useful in the practice of the present technology. There are three player position input devices 304 on the gaming table surface 302. Each of the player position input devices 304 has a side bet wagering input section 306 and adjacent thereto is shown a four-light element panel portion 308 useful in the practice of the present invention. Four lights are shown for purposes of convenience, although a single light, two lights, three lights or more lights may be provided. For purposes of discussion, having four light elements a, b, c and d is convenient. An optional lighting box 310 at the dealer or banker position with lights e and f is also shown. A first processor 314 is shown to monitor input of side bet wagers from the respective side bet wagering input sections 306. The connections from the first processor to the respective side bet wagering input sections 306 is shown as serial, but the connections 316 may be parallel. A second processor and/or processor with random number generator (preferably programmable) and/or random number generator only 312 associated with and in communication with the first processor 314 is also shown. These components operate as previously described. A source of random physical playing cards 320 is also shown on the table. The physical playing cards are delivered from the source 320 according to the structure of the table wagering event being performed. The source 320 may be a pre-shuffled delivery shoe of one or more sets/decks of playing cards, a batch shuffling machine, a continuous shuffling machine or even a printing element that provides randomly printed playing cards. The random playing card source 320 might have its own processor therein (e.g., as a shuffling or randomization device or as a card delivering shoe), or may be in communication with another processor, such as the gaming table first processor 314 which can implement and execute multiple functions. The three player position input devices (more devices may be used, but for simplifying the figure, three are shown) 304 on the gaming table surface 302 may be wagering input panels such as the D.E.Q. Platinum™ wagering box, or simpler proximity detectors for wagers (where the wagers would be recognized and hand retrieved by a dealer), or a drop box wagering device as known in the art where the individual wagers are recognized when coins/tokens/chips and the like are dropped through a slot and collected in a drop box. Each of Galaxy Gaming, Inc., D.E.Q. Gaming; AGS Inc., and Scientific Gaming have game tables with side bet wagering capability, and the present technology can be easily retrofit into those tables. All that needs to be minimally done is to add the light panel segments 308 and/or dealer position light panel 310 to the existing table and then provide lines of communication 318 between the light panel segments 308 310 and a processor (here the second processor 312) with a random number generating function. The RNG function in the processor 312 is performed upon recognition of the start of a new round of a wagering event, as by recognition of wagers entered through side bet wagering input section 306 and preferably also by locking of the side bet wager entries as by locking wagers through the dealer position locking input control 322.

The wagering event may be performed as with the gaming system wherein a source of random physical playing cards is available for use in an underlying physical playing card wagering event to be performed on the gaming table surface. Any physical card game may be used, such as blackjack, baccarat, poker variations, casino war, Acey-Deucey, and the like. The impact of the random lights may traverse a wide range of direct results on game outcomes and/or paytables. For example, in a simplest form, the presence of random lights at each player position may be a multiplier for any payout or an adjustment of the paytables. As is known, casinos have been reducing awards on blackjacks from the traditional 3/2 to 6/5, which is not desired by players. With or without a side bet, the random lights could alter the payout on blackjack, such as any lights randomly lit return the payout to 3/2, or one combination of lights could reduce the payout to 1/1, while other combinations of lights would pay 3/2 or even 2/1.

The impact of lights as modifying individual cards or pairs or more of cards at player and/or dealer positions has already been thoroughly addressed, but more variations could be implemented. One (or more) random light might could allow a discard from a player position, or enable a free card to be delivered. The player input control may include a wager mechanism for a side bet event accompanying the underlying physical playing card wagering event. The input control may communicate wagering input at the player position to the first processor and the first processor is configured to maintain an accounting function on a progressive jackpot event resolved at least in part by random playing cards provided to the player position from the source of random physical playing cards. The gaming system may have the input control communicate wagering input at the player position to the first processor and the first processor is configured to maintain an accounting function on a progressive jackpot event resolved at least in part by light elements on the game play surface being randomly lit or unlit.

The EGM gaming system may have the source of random virtual symbols is associated with a game processor providing a first set of symbols for use in a first wagering format selected from the group consisting of virtual playing card wagering events, column and row video virtual slot wagering events, virtual roulette wagering events, virtual keno wagering events, and virtual bingo wagering events. The gaming system may operate where the source of random virtual symbols is associated with a game processor providing a first set of symbols for use in a first wagering format selected from the group consisting of virtual playing card wagering events, column and row video virtual slot wagering events, virtual roulette wagering events, virtual keno wagering events, and virtual bingo wagering events. The gaming systems may be in communication with the first processor are multiple different wagering events selected from the group consisting of virtual playing card wagering events, column and row video virtual slot wagering events, virtual roulette wagering events, virtual keno wagering events, and virtual bingo wagering events, and the first processor randomly selects lights to be lit at each of the gaming tables having the multiple different wagering events. Each gaming table may be configured to perform multiple ones of the multiple different wagering events from a single player input terminal at the each gaming table.

The gaming system my have a player input terminal having a dedicated input function for wagering an amount into a progressive jackpot and the first processor executes software to manage the progressive jackpot by accumulating at least portions of the amounts wagered into the progressive jackpot and awarding at least portions of the progressive jackpot based upon random lighting of lights at the player position and/or the dealer/banker position.

A method of performing a wagering event during a wagering event on a gaming system may include:

a) the player position providing a wager that includes a wager against a paytable, outcomes or odds of the wager against the paytable being determined at least in part by whether or not a random number generator/processor has randomly caused a visual display element at the player position to appropriately identify a degree of a secondary random events be lit;

b) the processor/RNG making a random determination as to what the display at the card-receiving position is to be. Multiple random virtual symbols may be provided by a second processor to individual player positions at the game table and the light elements are associated with individual symbols as a distinct characterization of the random individual symbols used in determining wagering event outcomes.

In practicing this technology, it has been estimated that the novel gaming table with the randomly provided lights can provide at least four different generic classes of game effects during an underlying wagering event and a nearly infinite number of variations on side bets, paytables, frequency of positive events, and wagering event outcomes. For example:

Generic Classes of Game Effects:

1) A random event side bet game based on image combinations. 2) A random alteration of paytables in an underlying wagering event. 3) A random effect on game content and game outcome. 4) A random progressive event component necessary for attaining partial or total jackpot awards. 5) Random wild cards or replacement cards. 6) Random numbers of wild cards and replacement cards.

2) Random i) virtual symbols, ii) quantities of lights and/or iii) illuminated symbols are selected by the random number generator for display at individual player positions at the game table and content of i), ii) and/or iii) act as a distinct characterization of I) outcomes of the underlying primary random wagering event, II) available extra cards, III) available discards and replacements, IV) altered paytables on an underlying wagering event, V) altered paytables on a side bet, VI) altered paytables on a progressive jackpot or VII) entry into a bonus event on the underlying primary random wagering event. The secondary random event may be preferably weighted (each or multiple outcomes having different probabilities) or not.

Variations on Side Bets:

The side bet game based solely on light/image/number illumination frequency can be adjusted/designed by programming of the frequency of one or more lights/displays being lit to provide payouts based exclusively on whether 1, 2, 3, 4 (or any specific number and/or colors) lights are lit.

The random variation on side bet games by alteration of paytables is itself very broad in application. As mentioned above, in blackjack, the number of random lights (and/or random color lights) can alter the award on blackjack (as between 1:1, 6:5, 3:2; 2:1; 5:1; 10:1 and the like), can be a "defense" against a dealer's blackjack (allowing a loss of only 1/2 the player's wager or none of the player's wager), allowing a defense against 1/2 of a double down wager (if the player hand loses), allowing a player hand a defense against busting with a 22-count (causing it to be a tie), enabling a tie at 21 count to be a player win, etc.

In baccarat, the presence of random lights/displays may enable odds paid on ties to be higher than 8:1, 9:1 or 10:1, a player may be allowed an extra card (over-ruling normal rules) with reduced awards (e.g., 1/2 win available, a surrender available before or after dealing to conclusion), suited or number combinations receiving an award (e.g., two natural nines or natural eights may be a player win, etc.).

In poker games where Jacks or better are needed for a win, lights may enable 10's Or better or any other pair to be a winner against a paytable, odds for particular ranks may vary (e.g., in combination with two lights, trips may pay 7:2 rather than 3:1, straights may pay 5:1 rather than 4:1, etc.).

In a jackpot event, including progressive jackpots, the lights/displays can determine levels of award in the jackpot. For example, in addition to the possibility that the presence of a predefined number of lights can alter the paytable for a certain rank in an underlying event (paytables in Three-card Poker® games have been recently reduced, for example, where three-of-a-king used to pay 40:1, they now pay 30:1, so that the presence of a certain number of random lights can alter the paytable and return it to previously higher or yet higher again amounts), the lights may be essential elements in a progressive jackpot event such that A-K-Q of a specific suit (for maintaining a highest level of average progressive jackpot) or for A-K-Q of any suit will be awarded 5% of the total jackpot for a single random light in combination with that A-K-Q suited hand, two lights will provide an award of 15% of the progressive jackpot and three (or four) lights will award 100% of the progressive jackpot.

One aspect of this technology can be the fact that the use of a gaming table according to the present technology enables a distinct event on the table itself (the provision of random lights, random numbers of lights, the provision of random numbers and colors of lights, etc.) to alter any chosen aspect of the underlying game or side bet events desired.

It is also to be noted that, even though the location of lights has been emphasized at the player positions (independently) and/or the dealer position, a common light panel may be provided so that the common light panel is active with respect to every player that has made a side bet, or where the effect of the random lights is an underlying feature of the wagering event, the common light panel is active with respect to every player in the wagering event.

What is claimed:

1. A gaming system for enabling enhancement of wagering outcomes comprising:

a) a gaming table having a game play surface with individual player positions for multiple players to receive individual hands of at least two physical playing cards and at least one dedicated position for placement of a wager;

b) a programmable electronic random number generator;

c) a player input control at each of the individual player positions;

d) a display system at each individual player position capable of indicating a secondary random event outcome provided by the programmable electronic random number generator for each of the multiple player positions; and e) the random number generator controlling display on the display system of each individual player position secondary random event for each player position as determined by the random number generator from differently weighted secondary random events consisting of between 2-10 differently weighted secondary random events;

wherein the display of individual player position secondary random events is always locked on the display system of each individual player display system as virtual symbols or quantities of lights after a wager has been placed at one of the multiple player positions and before each individual player position has viewed any physical playing cards delivered to each individual player position; and wherein the individual player position secondary random event acts as a special marking on individual ones of the physical playing cards delivered to each individual player position.

* * * * *